US009297385B2

(12) United States Patent
Yamanaka et al.

(10) Patent No.: US 9,297,385 B2
(45) Date of Patent: Mar. 29, 2016

(54) VORTEX PREVENTION DEVICE AND DOUBLE SUCTION VERTICAL PUMP HAVING SUCH VORTEX PREVENTION DEVICE

(75) Inventors: Takashi Yamanaka, Tokyo (JP); Dai Kudo, Tokyo (JP); Shuichiro Honda, Tokyo (JP); Takashi Enomoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 953 days.

(21) Appl. No.: 13/498,213

(22) PCT Filed: Sep. 24, 2010

(86) PCT No.: PCT/JP2010/066508

§ 371 (c)(1),
(2), (4) Date: Mar. 26, 2012

(87) PCT Pub. No.: WO2011/037166

PCT Pub. Date: Mar. 31, 2011

(65) Prior Publication Data

US 2012/0195748 A1 Aug. 2, 2012

(30) Foreign Application Priority Data

Sep. 28, 2009 (JP) ..... 2009-222142
Jun. 4, 2010 (JP) ..... 2010-128609

(51) Int. Cl.
*F04D 29/00* (2006.01)
*F04D 13/08* (2006.01)
(Continued)

(52) U.S. Cl.
CPC ..... *F04D 13/08* (2013.01); *F04D 29/4273* (2013.01); *F04D 29/448* (2013.01); *F04D 29/548* (2013.01); *F04D 29/708* (2013.01)

(58) Field of Classification Search
CPC ... F04D 13/08; F04D 13/086; F04D 25/0686; F04D 29/4213; F04D 29/4273; F04D 29/4293; F04D 29/444; F04D 29/445; F04D 29/548; F04D 29/70; F04D 29/708
USPC ..... 137/565.37, 590, 565.17, 574; 415/103, 415/121.2, 119, 182.1, 183, 191
See application file for complete search history.

(56) References Cited

U.S. PATENT DOCUMENTS 2,383,424 A * 8/1945 Stepanoff ..... 415/98
2,625,110 A * 1/1953 Haentjens et al. ..... 417/423.12
(Continued)

FOREIGN PATENT DOCUMENTS

GB 1 500 552 A 2/1978
JP 54-152202 A 11/1979
(Continued)

OTHER PUBLICATIONS

International Search Report issued on Dec. 14, 2010 in PCT/JP10/066508 filed on Sep. 24, 2010.
(Continued)

*Primary Examiner* — Igor Kershteyn
*Assistant Examiner* — Woody A Lee, Jr.
(74) *Attorney, Agent, or Firm* — Oblon, McClelland, Maier & Neustadt, L.L.P.

(57) ABSTRACT

A vortex prevention device is capable of preventing creation of air entrained vortex and also provides a double suction vertical pump having such a vortex prevention device. The vortex prevention device is used in combination with the double suction vertical pump which is installed in an open channel and has an upper suction opening and a lower suction opening. The vortex prevention device includes a plate member as a vortex prevention structure arranged above the upper suction opening. The plate member is arranged away from the upper suction opening such that a passage is formed between the plate member and the upper suction opening.

6 Claims, 35 Drawing Sheets

(51) Int. Cl.

| | |
|---|---|
| ***F04D 29/42*** | (2006.01) |
| ***F04D 29/54*** | (2006.01) |
| ***F04D 29/70*** | (2006.01) |
| ***F04D 29/44*** | (2006.01) |

(56) References Cited

U.S. PATENT DOCUMENTS

| | | | | |
|---|---|---|---|---|
| 3,715,034 | A * | 2/1973 | Ivanoff | 210/242.3 |
| 6,533,543 | B2 * | 3/2003 | Tagomori et al. | 415/159 |
| 8,424,566 | B2 * | 4/2013 | Merchant et al. | 137/565.37 |
| 2001/0018023 | A1 | 8/2001 | Tagomori et al. | |
| 2002/0146313 | A1 | 10/2002 | Thut | |
| 2003/0196705 | A1 * | 10/2003 | Grayson | 137/590 |
| 2008/0187448 | A1 * | 8/2008 | Jones | 417/342 |

FOREIGN PATENT DOCUMENTS

| | | | |
|---|---|---|---|
| JP | S55-057675 | A | 4/1980 |
| JP | S57 109279 | U | 7/1982 |
| JP | 59 88293 | | 6/1984 |
| JP | 60 54795 | | 4/1985 |
| JP | S60-194198 | U | 12/1985 |
| JP | 1 176791 | | 12/1989 |
| JP | 2002 332983 | | 11/2002 |
| JP | 2010190184 | A * | 9/2010 |

OTHER PUBLICATIONS

Extended European Search Report issued Dec. 21, 2015 in Patent Application No. 10818838.4.

* cited by examiner

VORTEX PREVENTION DEVICE AND DOUBLE SUCTION VERTICAL PUMP HAVING SUCH VORTEX PREVENTION DEVICE

TECHNICAL FIELD

The present invention relates to a vortex prevention device for use in a double suction vertical pump, such as circulating water pump, used in a pump station or a power plant, and more particularly to a vortex prevention device for preventing air entrained vortex and submerged vortex which would be created when pumping water in a pump pit. The present invention further relates to a double suction vertical pump provided with such a vortex prevention device.

BACKGROUND ART

There is a recent trend to use a double suction vertical pump, instead of a single suction vertical pump, as a pump installed in a suction pit. The double suction vertical pump has an advantage of improved suction performance because a flow rate of water into each suction opening is approximately half of that in the single suction vertical pump. Therefore, NPSH (Net Positive Suction Head) can be low. The improved suction performance enables the pump to perform its pumping operation at a low water level, and thus the suction pit can be made shallow. Therefore, cost reduction of the suction pit can be achieved.

Further, the improved suction performance can make cavitation less likely to occur at an impeller inlet and can reduce adverse influences of the cavitation (e.g., bubbling, cavitation damage to impeller surface and casing surface resulting from collapse of bubbles). Thus, a set rotational speed of the impeller can be increased. As a result, the impeller can have a smaller diameter while maintaining its pumping performance, and pump size can be compact and cost reduction of the pump itself can be achieved.

Although the double suction vertical pump has the advantage of preventing the cavitation because of the half flow rate of water into each suction opening as compared with the single suction vertical pump, this type of pump is likely to cause an air entrained vortex developing from a water surface because one of two suction openings faces upward. This arrangement makes it difficult to lower the water level and to reduce the depth of the suction pit.

CITATION LIST

Patent Literature

Japanese laid-open patent publication No. 2002-332983

SUMMARY OF INVENTION

Technical Problem

The present invention has been made in view of the above drawback. It is therefore an object of the present invention to provide a vortex prevention device capable of preventing formation of an air entrained vortex around a double suction vertical pump. It is another object of the present invention to provide a double suction vertical pump capable of operating without forming the air entrained vortex.

Solution to Problem

In order to achieve the above object, one aspect of the present invention provides a vortex prevention device for use in combination with a double suction vertical pump which is installed in an open channel and has an upper suction opening and a lower suction opening, the vortex prevention device comprising: a vortex prevention structure arranged above the upper suction opening.

In a preferred aspect of the present invention, the vortex prevention structure comprises a plate member arranged with a gap formed between the plate member and the upper suction opening.

In a preferred aspect of the present invention, the vortex prevention structure comprises an umbrella-shaped plate member arranged with a gap formed between the plate member and the upper suction opening; and the plate member has a tapered peripheral portion inclined downwardly.

In a preferred aspect of the present invention, the vortex prevention structure comprises an umbrella-shaped plate member arranged with a gap formed between the plate member and the upper suction opening; and the plate member has a peripheral portion curved downwardly.

In a preferred aspect of the present invention, the vortex prevention structure comprises a net member arranged so as to cover the upper suction opening.

In a preferred aspect of the present invention, the vortex prevention structure includes an upper plate member and a lower plate member arranged away from each other; the lower plate member is located away from the upper suction opening; and the lower plate member has at its center an aperture located above the upper suction opening.

In a preferred aspect of the present invention, the vortex prevention structure comprises a plate member arranged with a gap formed between the plate member and the upper suction opening; and the plate member has an extension extending downstream with respect to flow of liquid in the open channel.

In a preferred aspect of the present invention, the vortex prevention structure comprises: a plate member arranged with a gap formed between the plate member and the upper suction opening; and at least one rib provided on an upper surface of the plate member.

In a preferred aspect of the present invention, the at least one rib comprises a plurality of ribs extending in radial direction of the upper suction opening.

In a preferred aspect of the present invention, the at least one rib comprises an annular rib extending along circumferential direction of the upper suction opening.

In a preferred aspect of the present invention, the vortex prevention structure comprises a plate member arranged with a gap formed between the plate member and the upper suction opening; the plate member is larger than a diameter of the upper suction opening; and the plate member has an aperture with a smaller diameter than the diameter of the upper suction opening.

In a preferred aspect of the present invention, the vortex prevention structure comprises a plurality of vertical plates arranged near the upper suction opening; and the vertical plates extend in radial direction of the upper suction opening.

In a preferred aspect of the present invention, the vortex prevention structure comprises a cylindrical member surrounding an exposed portion of a rotary shaft of the double suction vertical pump.

In a preferred aspect of the present invention, the vortex prevention structure comprises a vertical plate arranged above the upper suction opening; and the vertical plate is located downstream of the upper suction opening with respect to flow of liquid in the open channel.

In a preferred aspect of the present invention, the vortex prevention structure comprises at least one slope plate arranged above the upper suction opening; and the slope plate is inclined downwardly toward a downstream side with respect to flow of liquid in the open channel.

In a preferred aspect of the present invention, the at least one slope plate comprises a plurality of slope plates arranged in parallel along a vertical direction.

In a preferred aspect of the present invention, the slope plate is curved downwardly along the flow of liquid.

In a preferred aspect of the present invention, a double suction vertical pump which is installed in an open channel and has an upper suction opening and a lower suction opening, the pump comprising: the vertical prevention device as described above.

Advantageous Effects of Invention

According to the present invention, the vortex prevention structure is provided above the upper suction opening. This arrangement can make it less likely to form the air entrained vortex from the water surface in the open channel. Therefore, the pump can perform its pumping operation at a low water level, compared with the single suction vertical pump which has only a single suction opening. As a result, the open channel can be designed to have a reduced height thereof, and cost reduction of a pump station can be achieved.

DESCRIPTION OF EMBODIMENTS

Embodiments of the present invention will be described below with reference to the drawings.

Figure 1:
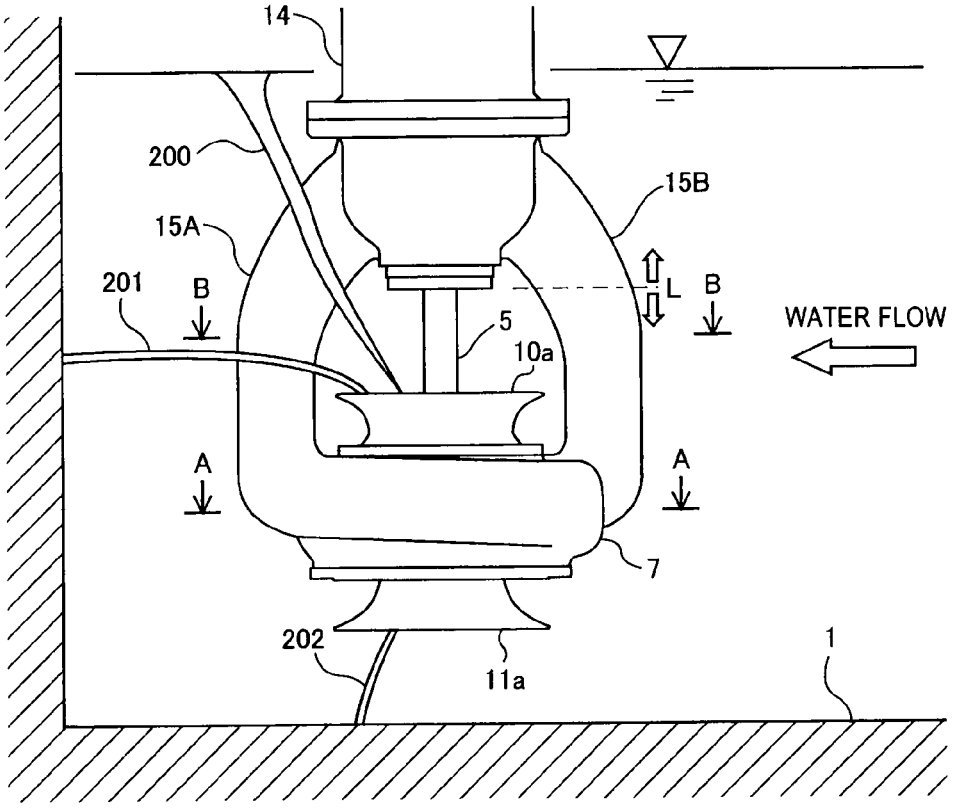
FIG. 1 is a side view of a double suction vertical pump provided in a suction pit.
Figure 2A:
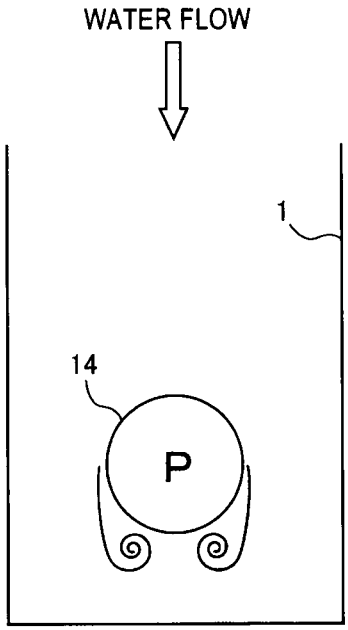
FIG. 2A is a plan view showing a positional relationship between the suction pit and the double suction vertical pump.
Figure 2B:
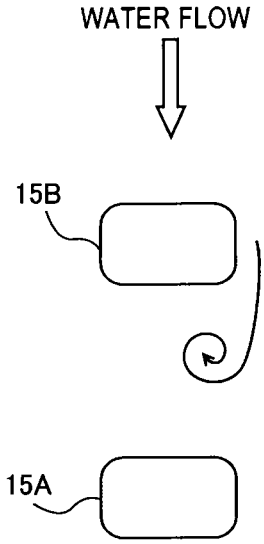
FIG. 2B is a plan view showing a positional relationship between the suction pit and the double suction vertical pump.
Figure 3:
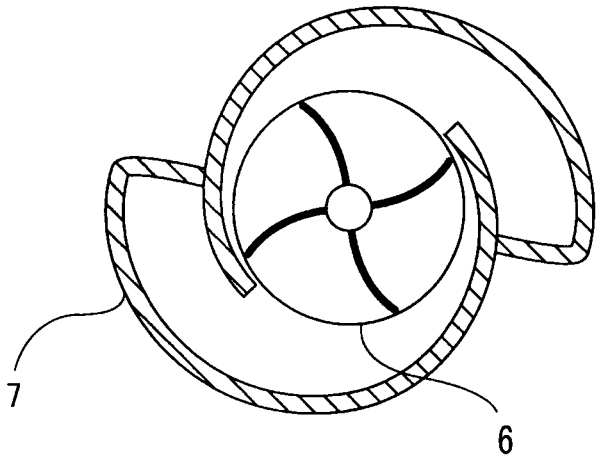
FIG. 3 is a cross-sectional view taken along line A-A shown in FIG. 1.
Figure 4:
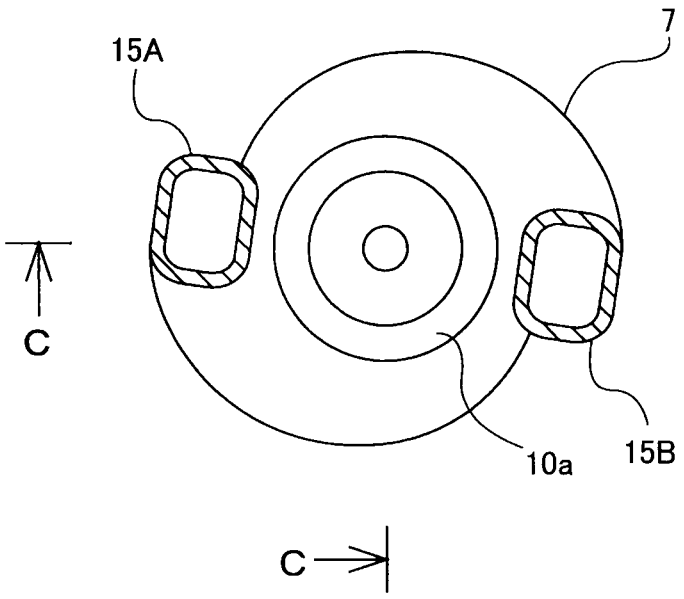
FIG. 4 is a cross-sectional view taken along line B-B shown in FIG. 1.
Figure 5:
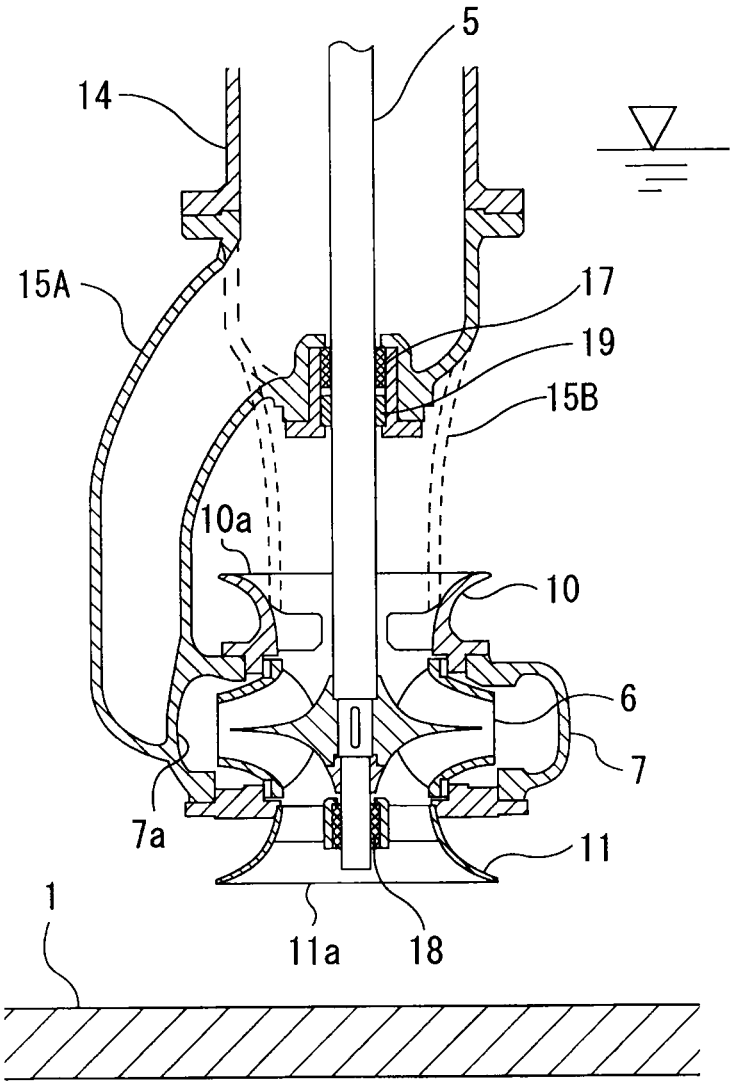
FIG. 5 is a cross-sectional view taken along line C-C shown in FIG. 4.

FIG. 1 is a side view of a double suction vertical pump installed in a suction pit. FIG. 2A and FIG. 2B are views each showing a positional relationship between the suction pit and the double suction vertical pump. FIG. 3 is a cross-sectional view taken along line A-A shown in FIG. 1, and FIG. 4 is a cross-sectional view taken along line B-B shown in FIG. 1. FIG. 5 is a cross-sectional view taken along line C-C shown in FIG. 4.

As shown in FIG. 1 through FIG. 5, the double suction vertical pump is installed in a suction pit 1 which is an open channel. This double suction vertical pump has a rotary shaft 5 extending in a vertical direction, a double suction impeller 6 secured to the rotary shaft 5, a casing 7 for housing the impeller 6, and an upper bell mouth 10 and a lower bell mouth 11 secured to an upper portion and a lower portion of the casing 7, respectively.

The upper bell mouth 10 has an upper suction opening 10*a* facing upward, and the lower bell mouth 11 has a lower suction opening 11*a* facing downward. The casing 7 has a volute chamber 7*a* shaped so as to surround the impeller 6. This volute chamber 7*a* is in communication with a column pipe 14 through two discharge pipes 15A and 15B, which serve as legs that couple the column pipe 14 to the casing 7. The column pipe 14 extends in the vertical direction, and the rotary shaft 5 extends through the column pipe 14. The rotary shaft 5 is rotatably supported by a submerged bearing 17 provided on the column pipe 14 and a submerged bearing 18 provided on the lower bell mouth 11. The submerged bearing 17 is located at a lower end of the column pipe 14, and a bush 19 is provided below the submerged bearing 17. The bush 19 has an inner circumferential surface surrounding the rotary shaft 5, so that a small gap is formed between the bush 19 and the rotary shaft 5. The bush 19, which is provided outwardly of the submerged bearing 17, can prevent pressurized water from leaking to the exterior of the column pipe 14.

The rotary shaft 5 is coupled to a drive source (not shown), so that the rotary shaft 5 and the impeller 6 are rotated together by the drive source. As the impeller 6 is rotated, water in the suction pit 1 is sucked into the casing 7 through the upper suction opening 10*a* and the lower suction opening 11*a*. The water is pressurized by the rotating impeller 6 to flow through the discharge pipes 15A and 15B and is delivered upwardly through the column pipe 14. Electrical motor, diesel engine, gas turbine, or the like can be used as the drive source.

The two discharge pipes (legs) 15A and 15B are symmetrical about the rotary shaft 5. Further, these discharge pipes 15A and 15B are arranged along a flow direction of the water in the suction pit 1. More specifically, the discharge pipe 15B is arranged upstream of the suction mouths 10*a* and 11*a*, and the discharge pipe 15A is arranged downstream of the suction mouths 10*a* and 11*a*.

In the double suction vertical pump, suction vortexes 200, 201, and 202 tend to grow from interfaces as shown in FIG. 1. The suction vortex 200 is an air entrained vortex (free-surface vortex with air core or bubble to intake) growing from an interface between air and water. The suction vortex 201 is a submerged vortex growing form an interface between a back wall of the suction pit 1 and the water. The suction vortex 202 is a submerged vortex growing from an interface between a bottom of the suction pit 1 and the water. The suction vortex 201 is likely to grow when a distance between the suction opening 10*a* of the pump and the back wall of the suction pit 1 is short. Therefore, the pump is arranged such that the discharge pipe (leg) 15A faces the back wall, so that the suction opening 10*a* is far away from the back wall.

Ease of the formation of the suction vortex 200 varies depending on a distance between the upper suction opening 10*a* and the water surface. The shorter the distance is, the more likely the suction vortex 200 is formed. Further, the suction vortex 200 is created in different manners depending on the water level of the suction pit 1. Specifically, in FIG. 1, water level L is located at a junction of the two discharge pipes 15A and 15B, i.e., at the lower end of the column pipe 14. When the water level in the suction pit 1 is higher than the level L, separation vortex, which is Karman vortex, is formed downstream of the column pipe 14 as shown in FIG. 2A. This separation vortex triggers the formation of the suction vortex 200. When the water level in the suction pit 1 is lower than the level L, the existence of the upstream-side discharge pipe 15B causes formation of separation vortex, which is Karman vortex, right above the upper suction opening 10*a* as shown in FIG. 2B. This separation vortex triggers the formation of the air entrained vortex.

In this manner, the air entrained vortex depends on the distance between the water surface and the suction opening and further depends on the formation of the separation vortex in the form of Karman vortex. Therefore, increasing the distance between the water surface and the suction opening 10*a* and destroying the separation vortex (swirling flow) are effective in preventing the air entrained vortex. Thus, this double suction vertical pump includes a vortex prevention device for preventing the formation of the air entrained vortex. Hereinafter, the vortex prevention device will be described in detail.

Figure 6:
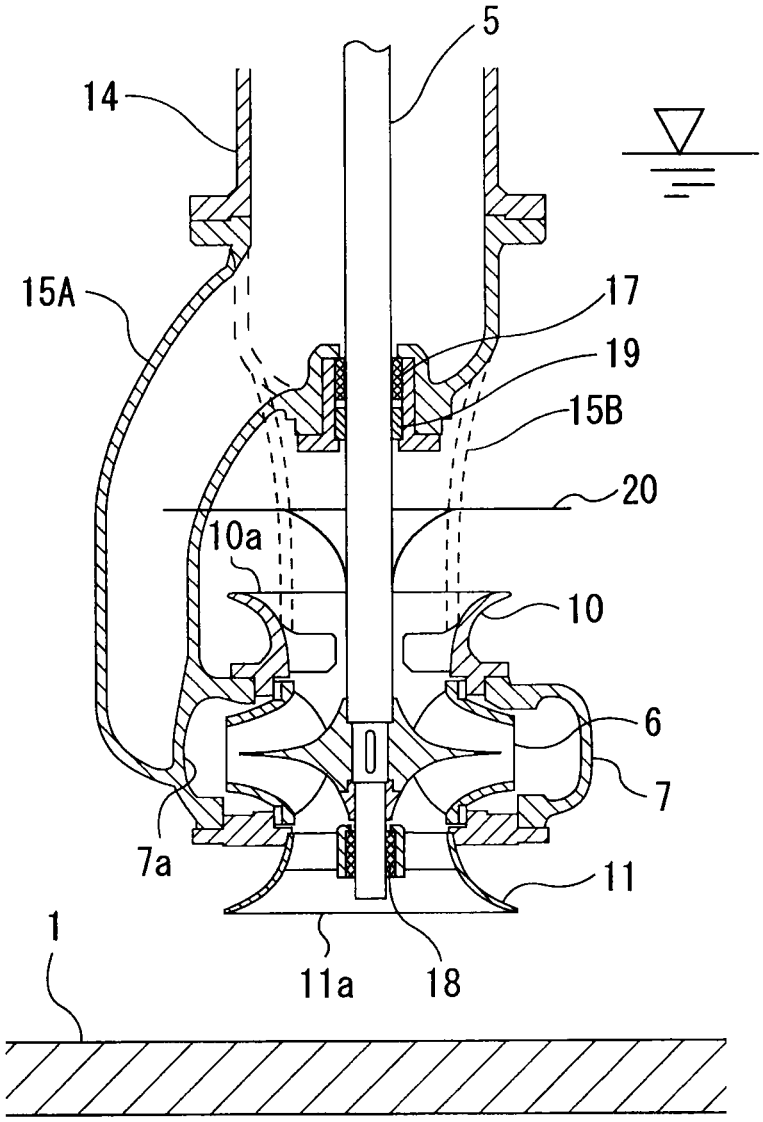
FIG. 6 is a double suction vertical pump including a vortex prevention device according to an embodiment of the present invention.

FIG. 6 is a cross-sectional view of the double suction vertical pump provided with the vortex prevention device according to an embodiment of the present invention. As shown in FIG. 6, a plate member 20 serving as a vortex prevention structure for preventing the air entrained vortex growing from the water surface is provided above the upper suction opening 10*a*. This plate member 20 is arranged away from the upper suction opening 10*a* such that a gap (i.e., a water passage) is formed between the plate member 20 and the upper suction opening 10*a*. The plate member 20 is located between the column pipe 14 and the upper suction opening 10*a*, and the rotary shaft 5 penetrates the plate member 20. The plate member 20 is secured to the above-described two discharge pipes 15A and 15B and is located below the water surface.

Figure 7:
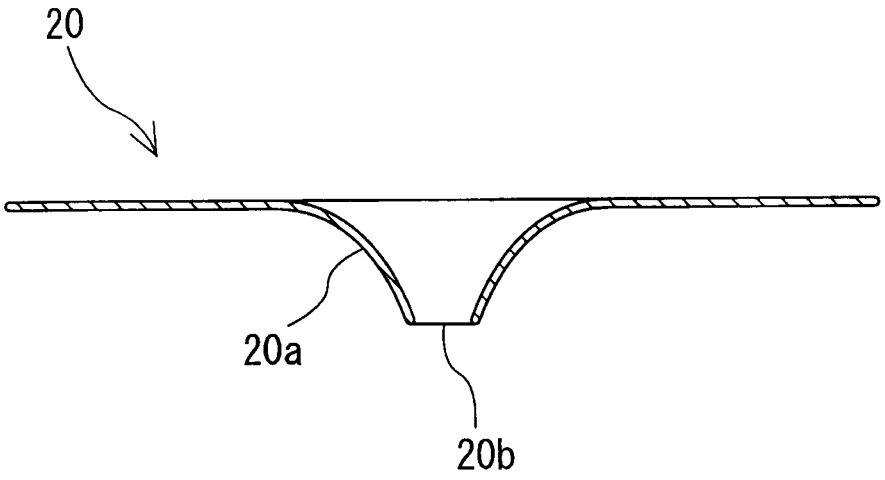
FIG. 7 is a longitudinal-section view of a plate member shown in FIG. 6.

FIG. 7 is a longitudinal-section view of the plate member shown in FIG. 6. The plate member 20 has at its center a projecting portion 20*a* projecting downwardly and having approximately a truncated cone shape. The plate member 20 has a through-hole 20*b* formed in the center of the projecting portion 20*a*, so that the rotary shaft 5 extends through the through-hole 20*b*. The plate member 20 in its entirety, other than the projecting portion 20*a*, has a flat surface. The plate member 20 has a size (i.e., lateral dimension) larger than a diameter of the upper suction opening 10*a* so as to cover the upper suction opening 10*a* with the gap formed between the plate member 20 and the upper suction opening 10*a*. Therefore, the upper suction opening 10*a* faces substantially laterally. As a result, the distance from the water surface to the upper suction opening 10*a* becomes long, whereby the air entrained vortex is less likely to be created. The shape of the plate member 20 is not limited particularly. Examples of the shape of the plate member 20 to be used include a disk shape, a rectangle, and a polygon.

Figure 8:
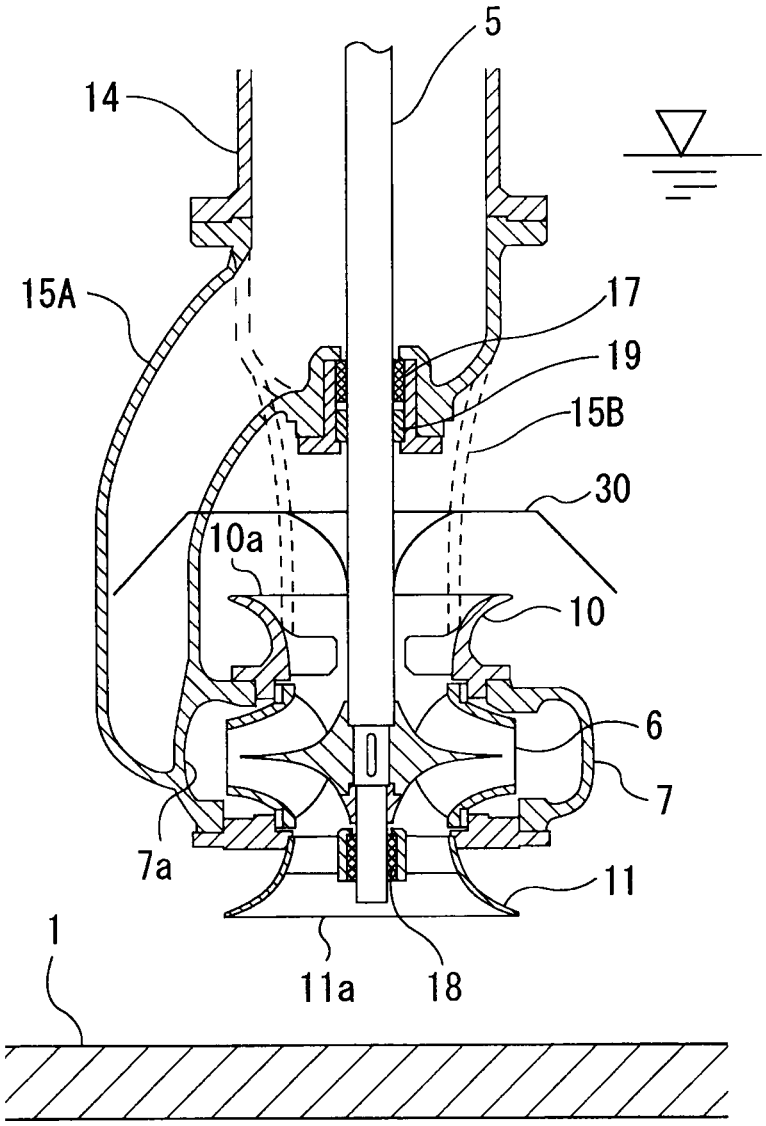
FIG. 8 is a cross-sectional view of the double suction vertical pump including the vortex prevention device according to another embodiment of the present invention.

FIG. 8 is a cross-sectional view of the double suction vertical pump including the vortex prevention device according to another embodiment of the present invention. This vortex prevention device has an umbrella-shaped plate member 30 serving as the vortex prevention structure disposed above the upper suction opening 10*a*. This plate member 30 is arranged away from the upper suction opening 10*a* so as to form a gap (i.e., water passage) between the plate member 30 and the upper suction opening 10*a*. The plate member 30 is located between the column pipe 14 and the upper suction opening 10*a*, and the rotary shaft 5 extends through the plate member 30. The plate member 30 is secured to the above-described two discharge pipes 15A and 15B and is located below the water surface.

Figure 9:
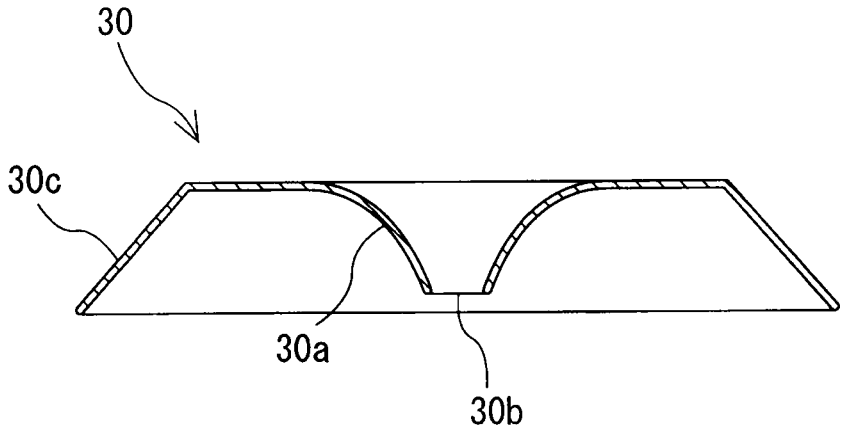
FIG. 9 is a longitudinal-section view of an umbrella-shaped plate member shown in FIG. 8.

FIG. 9 is a longitudinal-section view of the umbrella-shaped plate member shown in FIG. 8. The plate member 30 has a projecting portion 30*a* at a center thereof. This projecting portion 30*a* projects downwardly and is approximately in the shape of truncated cone. The projecting portion 30*a* has a through-hole 30*b* through which the rotary shaft 5 extends. The plate member 30 has a peripheral portion constituted by a tapered portion 30*c* inclined downwardly toward the radially outward side. The plate member 30 has a diameter larger than the diameter of the upper suction opening 10*a*, so that the upper suction opening 10*a* is covered with the plate member 30 with the gap formed therebetween. The plate member 30 has its outermost peripheral edge which is at the same height as or lower than the upper suction opening 10*a*. Therefore, the upper suction opening 10*a* faces downward substantially, so that the distance from the water surface to the upper suction opening 10*a* becomes even longer. The formation of the air entrained vortex is thus prevented more effectively.

Figure 10:
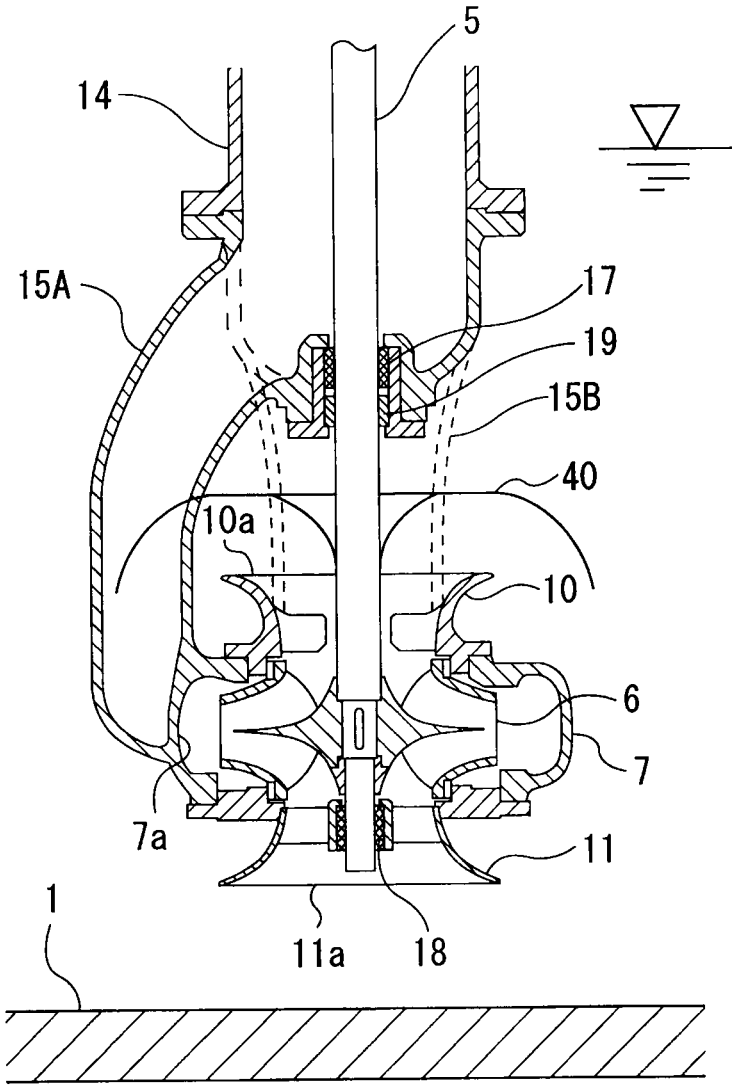
FIG. 10 is a cross-sectional view of the double suction vertical pump including the vortex prevention device according to still another embodiment of the present invention.
Figure 11:
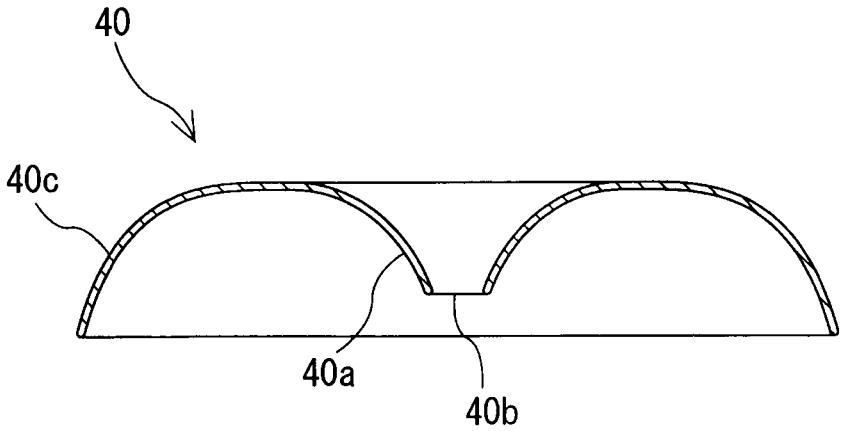
FIG. 11 is a longitudinal-section view of an umbrella-shaped plate member shown in FIG. 10.

FIG. 10 is a cross-sectional view of the double suction vertical pump including the vortex prevention device according to still another embodiment of the present invention. Structures and arrangements of this embodiment, which will not described below, are the same as those of the embodiment shown in FIG. 8 and FIG. 9 and their repetitive descriptions will be omitted. In this embodiment also, an umbrella-shaped plate member 40 serving as the vortex prevention structure is arranged above the upper suction opening 10*a*. FIG. 11 is a longitudinal-section view of the umbrella-shaped plate member shown in FIG. 10. The plate member 40 has a projecting portion 40*a* at a center thereof. This projecting portion 40*a* projects downwardly and is approximately in the shape of truncated cone. The projecting portion 40*a* has at its center a through-hole 40*b* through which the rotary shaft 5 extends. The plate member 40 further has a peripheral portion constituted by a curved portion 40*c* which is curved downwardly toward the radially outward side. The curved portion 40*c* and the central projecting portion 40*a* provide a smooth flow passage inside the plate member 40.

The plate member 40 has a diameter larger than the diameter of the upper suction opening 10*a*, so that the upper suction opening 10*a* is covered with the plate member 40 with a gap formed therebetween. The plate member 40 has its outermost peripheral edge which is at the same height as or lower than the upper suction opening 10*a*. Therefore, the upper suction opening 10*a* faces downward substantially, so that the distance from the water surface to the upper suction opening 10*a* becomes even longer. The formation of the air entrained vortex is thus prevented more effectively. Furthermore, because the smooth flow passage is formed inside the plate member 40, a flow passage area does not increase sharply and thus pressure loss hardly occurs. Therefore, the plate member 40 can prevent the formation of the air entrained vortex while preventing the decrease in pump performance.

In order to enable the umbrella-shaped plate member (represented by the reference numerals 30 and 40) serving as the vortex prevention structure shown in FIG. 9 through FIG. 11 to provide its vortex preventing function effectively, it is necessary that the plate member have a larger diameter in its entirety to some degree than the diameter of the upper suction opening 10*a*. If the upper suction opening 10*a* has a large diameter, it is necessary to make the dimension of the plate member larger in order to suppress the sharp increase in the flow passage area so as to prevent the pressure loss. As a result, the plate member could protrude outside the discharge pipes (legs) 15A and 15B, making it difficult to achieve a compact pump. Thus, it is preferable to make the upper suction opening 10*a* smaller than an upper suction opening of a conventional double suction vertical pump so as to allow the plate member to lie inside the discharge pipes (legs) 15A and 15B.

Figure 12:
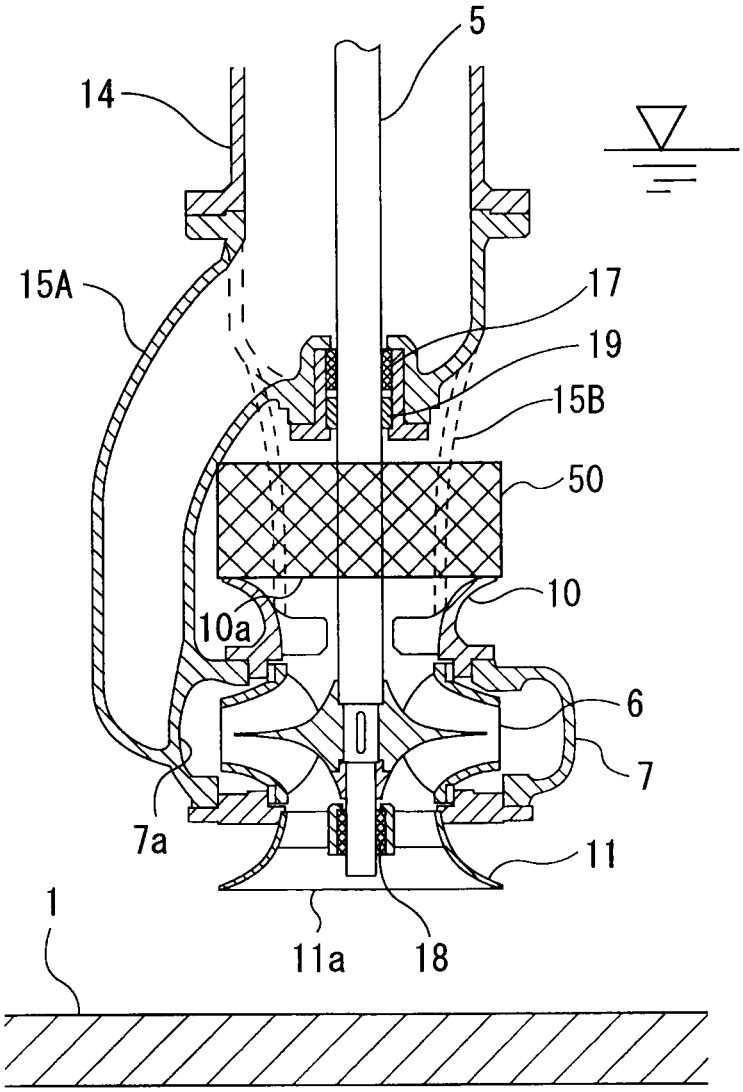
FIG. 12 is a cross-sectional view of the double suction vertical pump including the vortex prevention device according to still another embodiment of the present invention.
Figure 13A:
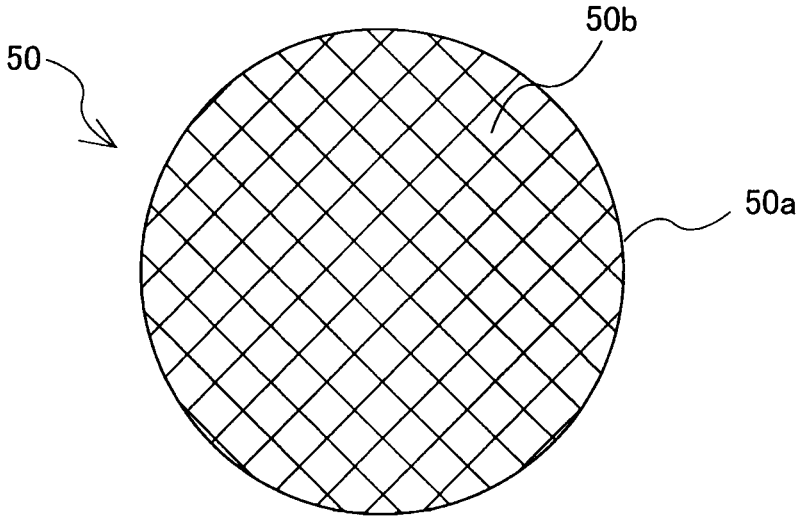
FIG. 13A is a plan view of a net member shown in FIG. 12.
Figure 13B:
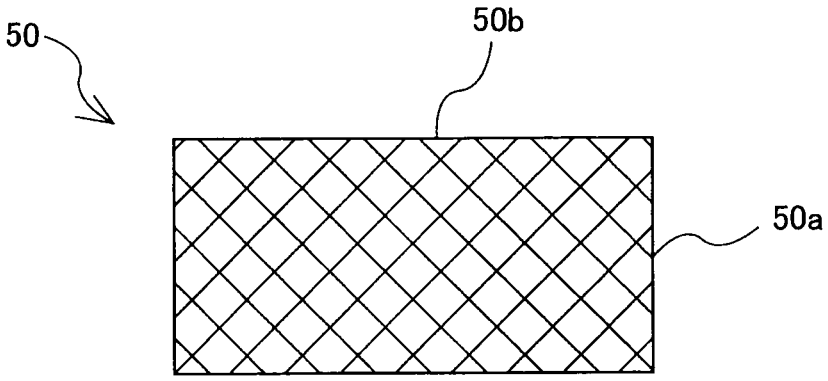
FIG. 13B is a side view of the net member shown in FIG. 12.

FIG. 12 is a cross-sectional view of the double suction vertical pump including the vortex prevention device according to still another embodiment of the present invention. As shown in FIG. 12, in this embodiment, a net member 50 serving as the vortex prevention structure is arranged so as to cover the upper suction opening 10*a*. This net member 50 is secured to the upper bell mouth 10 and is located below the water surface. FIG. 13A is a plan view of the net member shown in FIG. 12, and FIG. 13B is a side view of the net member. The net member 50 has a cylindrical circumferential wall 50*a* and an upper wall 50*b* covering an upper opening of the circumferential wall 50*a*. The net member 50 is not limited to the cylindrical shape, and other shape can be applied. This net member 50 can destroy the air entrained vortex before it enters the upper suction opening 10*a*.

Figure 14:
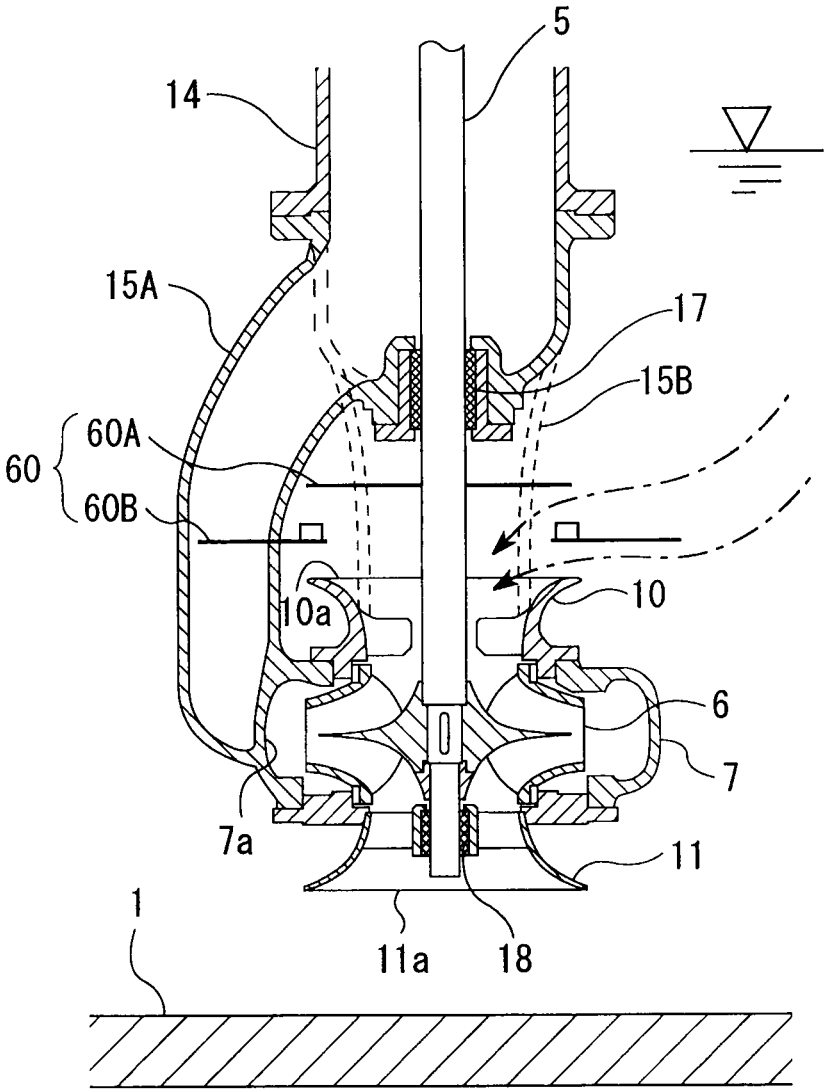
FIG. 14 is a cross-sectional view of the double suction vertical pump including the vortex prevention device according to still another embodiment of the present invention.

FIG. 14 is a cross-sectional view of the double suction vertical pump including the vortex prevention device according to still another embodiment of the present invention. This vortex prevention device includes a double plate member 60 serving as the vortex prevention structure arranged above the upper suction opening 10*a*. This double plate member 60 includes an upper plate member 60A and a lower plate member 60B which are arranged horizontally and are parallel to each other. The upper plate member 60A and the lower plate member 60B are arranged away from each other and are arranged coaxially. Further, in order to form a gap (i.e., water passage) between the lower plate member 60B and the upper suction opening 10*a*, the lower plate member 60B is located away from the upper suction opening 10*a*. The double plate member 60 is located between the column pipe 14 and the upper suction opening 10*a*, and the rotary shaft 5 extends through the double plate member 60. The double plate member 60 is secured to the above-described two discharge pipes 15A and 15B and is located below the water surface. A size (lateral dimension) of the upper plate member 60A is smaller than a size (lateral dimension) of the lower plate member 60B, which is larger than the diameter of the upper suction opening 10*a*.

Figure 15:
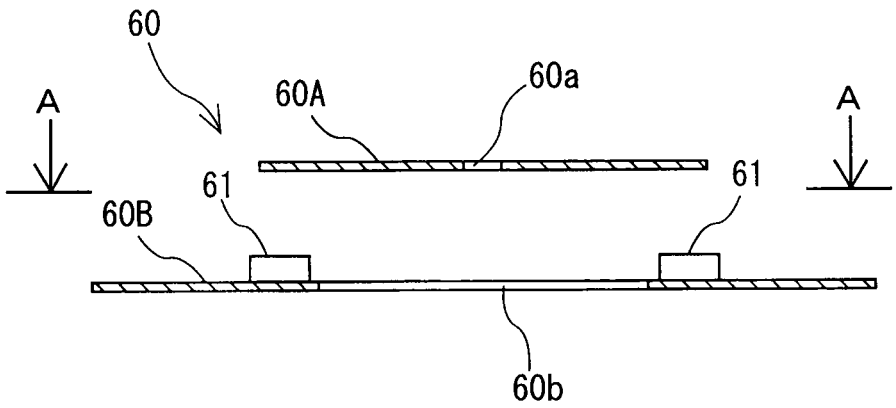
FIG. 15 is a longitudinal-section view of a double plate member shown in FIG. 14.
Figure 16:
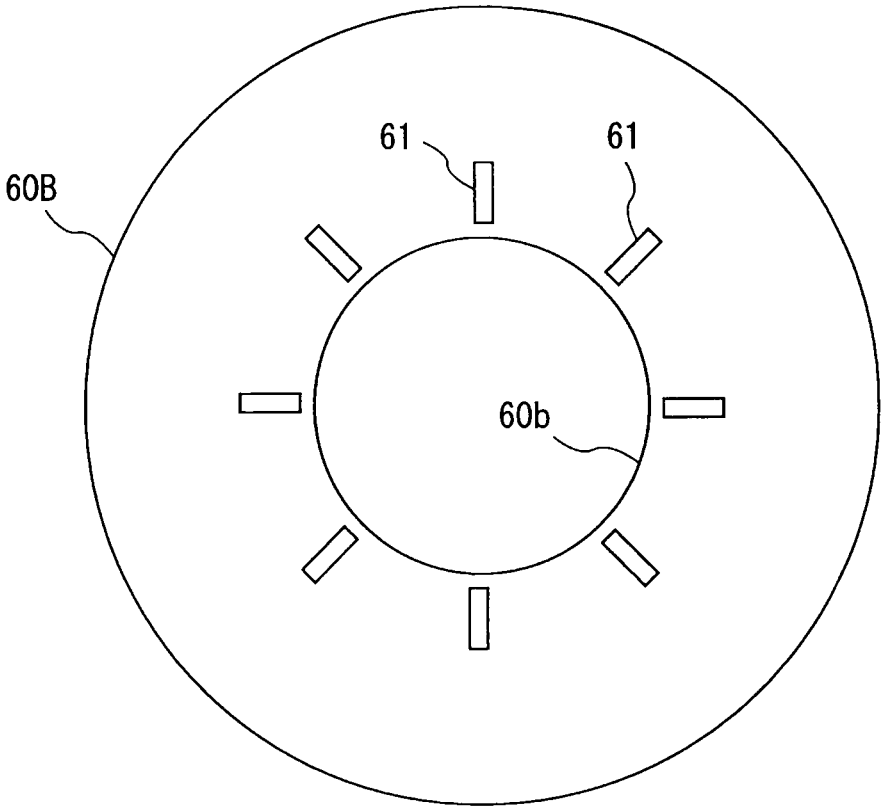
FIG. 16 is a view from a direction indicated by line A-A shown in FIG. 15.

FIG. 15 is a longitudinal-section view of the double plate member shown in FIG. 14. FIG. 16 is a view from a direction indicated by line A-A in FIG. 15. The upper plate member 60A has at its center a through-hole 60*a* through which the rotary shaft 5 extends. The lower plate member 60B also has at its center an aperture 60*b* through which the rotary shaft 5 extends. This aperture 60*b* is located above the upper suction opening 10*a* and is concentric with the upper suction opening 10*a*. A diameter of the aperture 60*b* is smaller than the size of the upper plate member 60A and is slightly smaller than the diameter of the upper suction opening 10*a*. The diameter of the aperture 60*b* may be the same as or slightly larger than the diameter of the upper suction opening 10*a*. Plural protrusions 61 are provided on an upper surface of the lower plate member 60B. These protrusions 61 are arranged so as to surround the aperture 60*b* at equal intervals in a circumferential direction and extend in the radial direction of the aperture 60*b*. The protrusions 61 have a function to suppress swirling components of suction flow formed by the impeller 6 to thereby improve the suction performance.

The double plate member 60 thus arranged divides a water path into two, which then meet. The air entrained vortex is destroyed by the water flow that has once been divided into two and then they have joined together. Therefore, ingress of the air entrained vortex into the upper suction opening 10*a* can be prevented.

Figure 17:
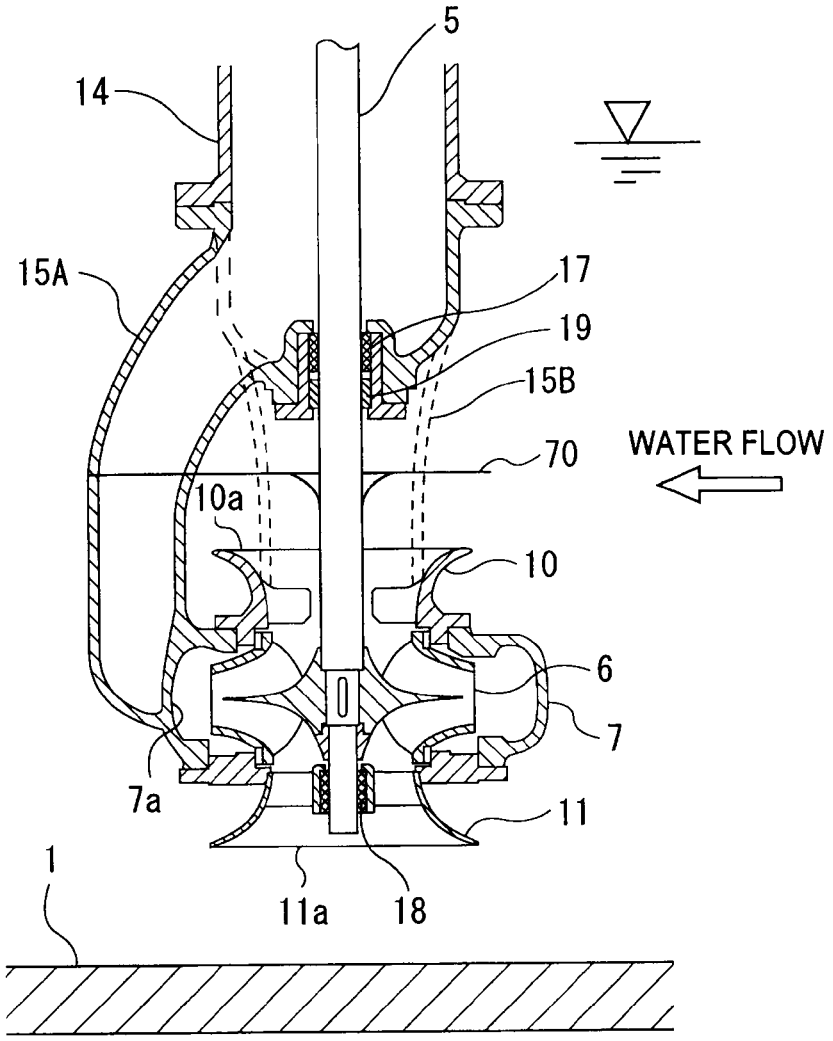
FIG. 17 is a cross-sectional view of the double suction vertical pump including the vortex prevention device according to still another embodiment of the present invention.

FIG. 17 is a cross-sectional view of the double suction vertical pump including the vortex prevention device according to still another embodiment of the present invention. A plate member 70 serving as the vortex prevention structure is disposed above the upper suction opening 10*a*. This plate member 70 is arranged away from the upper suction opening 10*a* such that a gap (i.e., water passage) is formed between the plate member 70 and the upper suction opening 10*a*. The plate member 70 is located between the column pipe 14 and the upper suction opening 10*a*. The rotary shaft 5 extends through the plate member 70. The plate member 70 is secured to the above-described two discharge pipes 15A and 15B and is located below the water surface.

Figure 18A:
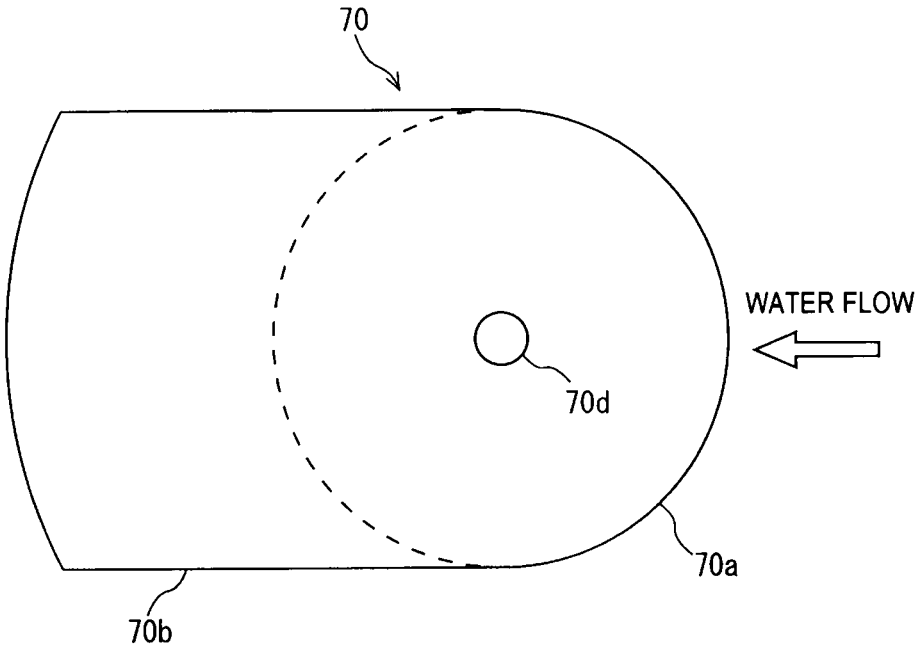
FIG. 18A is a plan view of a plate member shown in FIG. 17.
Figure 18B:
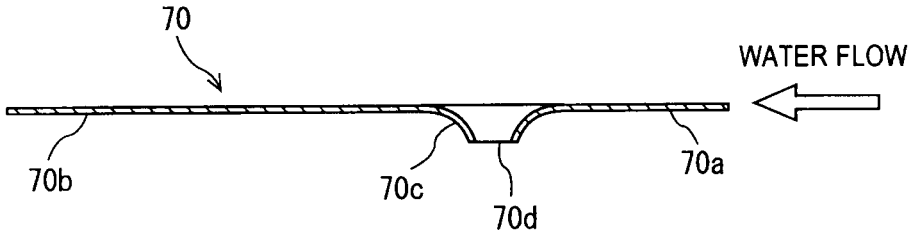
FIG. 18B is a cross-sectional view of the plate member shown in FIG. 17.

FIG. 18A is a plan view of the plate member shown in FIG. 17, and FIG. 18B is a longitudinal-section view of the plate member shown in FIG. 17. The plate member 70 has an extended portion located at its downstream side with respect to the water flow in the suction pit 1. Specifically, the plate member 70 has, as viewed from above, a circular plate 70*a* and an extension 70*b* connected integrally to a downstream edge of the circular plate 70*a*. The circular plate 70*a* has at its center a projecting portion 70*c* projecting downwardly and having approximately a truncated cone shape. The projecting portion 70*c* has a through-hole 70*d* formed in the center thereof, so that the rotary shaft 5 extends through the through-hole 70*d*. The circular plate 70*a* in its entirety, other than the projecting portion 70*c*, has a flat surface. The plate member 70 has a size (lateral dimension) larger than the diameter of the upper suction opening 10*a* so as to cover the upper suction opening 10*a* with the gap formed between the plate member 70 and the upper suction opening 10*a*. Therefore, the upper suction opening 10*a* faces substantially laterally. As a result the distance from the water surface to the upper suction opening 10*a* becomes long, whereby the air entrained vortex is less likely to be created.

As shown in FIG. 1, the air entrained vortex 200 is likely to be formed downstream of the column pipe 14. In this embodiment, the plate member 70 having the extension 70*b* extending in the downstream direction is provided above the upper suction opening 10*a*. This arrangement can prevent the air entrained vortex from being created. A shape of the plate member 70 in its entirety is not limited to the embodiment shown in the figures. For example, the plate member 70 may have a rectangular shape having the above-described extension. Further, the plate member 70 may have a peripheral portion that is inclined or curved downward as shown in FIG. 9 or FIG. 11.

Figure 19:
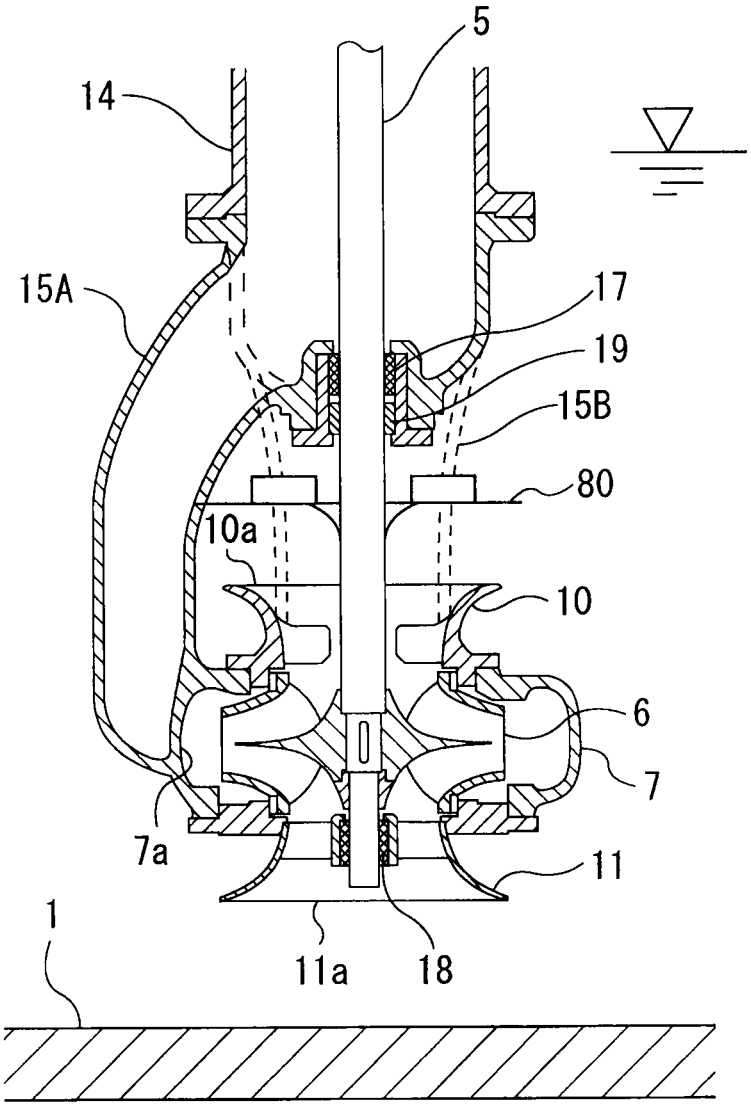
FIG. 19 is a cross-sectional view of the double suction vertical pump including the vortex prevention device according to still another embodiment of the present invention.

FIG. 19 is a cross-sectional view of the double suction vertical pump including the vortex prevention device according to still another embodiment of the present invention. A vortex prevention structure 80 according to this embodiment has a plate member 80*a* and oblong ribs 80*b* secured to an upper surface of the plate member 80*a*. The plate member 80*a* is located above the upper suction opening 10*a*. This plate member 80*a* is arranged away from the upper suction opening 10*a* such that a gap (i.e., water passage) is formed between the plate member 80*a* and the upper suction opening 10*a*. The plate member 80*a* is located between the column pipe 14 and the upper suction opening 10*a*. The rotary shaft 5 extends through the plate member 80*a*. The plate member 80*a* is secured to the above-described two discharge pipes 15A and 15B and is located below the water surface.

Figure 20A:
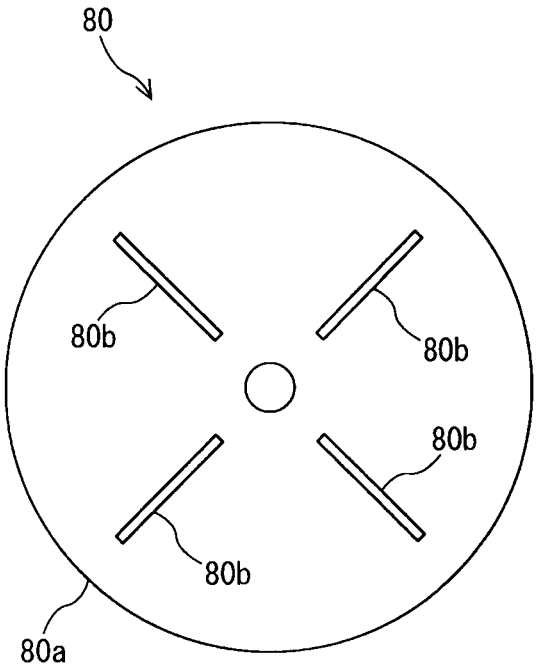
FIG. 20A is a plan view of a vortex prevention structure shown in FIG. 19.
Figure 20B:
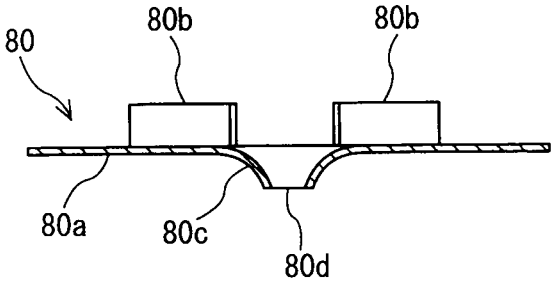
FIG. 20B is a longitudinal-section view of the vortex prevention structure shown in FIG. 19.

FIG. 20A is a plan view of the vortex prevention structure shown in FIG. 19, and FIG. 20B is a longitudinal-section view of the vortex prevention structure shown in FIG. 19. The ribs 80*b* extend in radial direction of the plate member 80*a* and the upper suction opening 10*a*, and are arranged around a center of the plate member 80*a* at equal intervals. There is no particular limit to positional relationship between the ribs 80*b* and the discharge pipes (legs) 15A and 15B. Although four ribs 80*b* are provided in the embodiment shown in the figures, the number of ribs 80*b* is not limited to a particular number. Further, although the plate member 80*a* shown in the figures has a circular disk shape, the plate member 80*a* is not limited to this embodiment and may have other shape, such as a rectangular shape. The plate member 80*a* may have a peripheral portion that is inclined or curved downward as shown in FIG. 9 or FIG. 11.

The plate member 80*a* has at its center a projecting portion 80*c* projecting downwardly and having approximately a truncated cone shape. The projecting portion 80*c* has a through-hole 80*d* formed in the center thereof, so that the rotary shaft 5 extends through the through-hole 80*d*. The plate member 80*a* in its entirety, other than the projecting portion 80*c*, has a flat surface. The plate member 80*a* has a size (lateral dimension) larger than the diameter of the upper suction opening 10*a* so as to cover the upper suction opening 10*a* with the gap formed between the plate member 80*a* and the upper suction opening 10*a*. Therefore, the upper suction opening 10*a* faces substantially laterally. As a result the distance from the water surface to the upper suction opening 10*a* becomes long, whereby the air entrained vortex is less likely to be created. Further, the ribs 80*b* disturb the water flow near the upper suction opening 10*a* to thereby prevent formation of a stable vortex. In addition, the ribs 80*b* enhance stiffness of the plate member 80*a* and can thus prevent vibration of the plate member 80*a* which could be caused by the water flow.

Figure 21A:
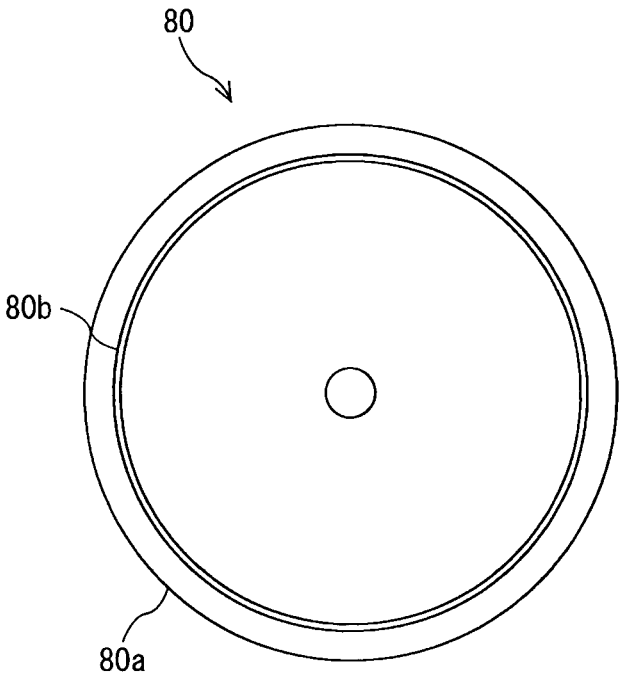
FIG. 21A is a view of another example of the vortex prevention structure according to the embodiment of the invention.
Figure 21B:
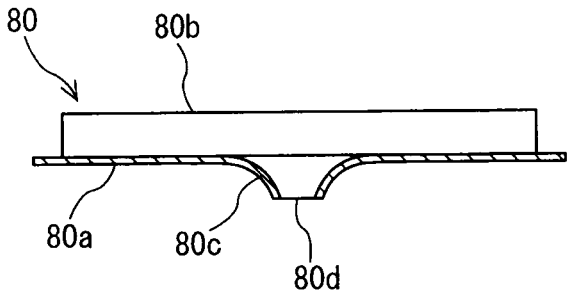
FIG. 21B is a longitudinal-section view of the vortex prevention structure shown in FIG. 21A.

FIG. 21A is a plate view showing another example of the vortex prevention structure according to the embodiment of the invention, and FIG. 21B is a longitudinal-section view of the vortex prevention structure shown in FIG. 21A. In this example, an annular rib 80*b*, extending in the circumferential direction of the plate member 80*a* and the upper suction opening 10*a*, is provided on the upper surface of the plate member 80*a*. The rib 80*b* is arranged near a peripheral edge of the plate member 80*a* and extends in the entire circumference of the plate member 80*a* to form an annular wall. In this example also, the same effects as those of the ribs shown in FIG. 20A and FIG. 20B can be obtained. The rib 80*b* may be in contact with the discharge pipes 15A and 15B. Further, the rib 80*b* may have cutout portions which are shaped along the shape of the discharge pipes 15A and 15B, respectively. The plate member 80*a* may have a peripheral portion that is inclined or curved downward as shown in FIG. 9 or FIG. 11.

Figure 22:
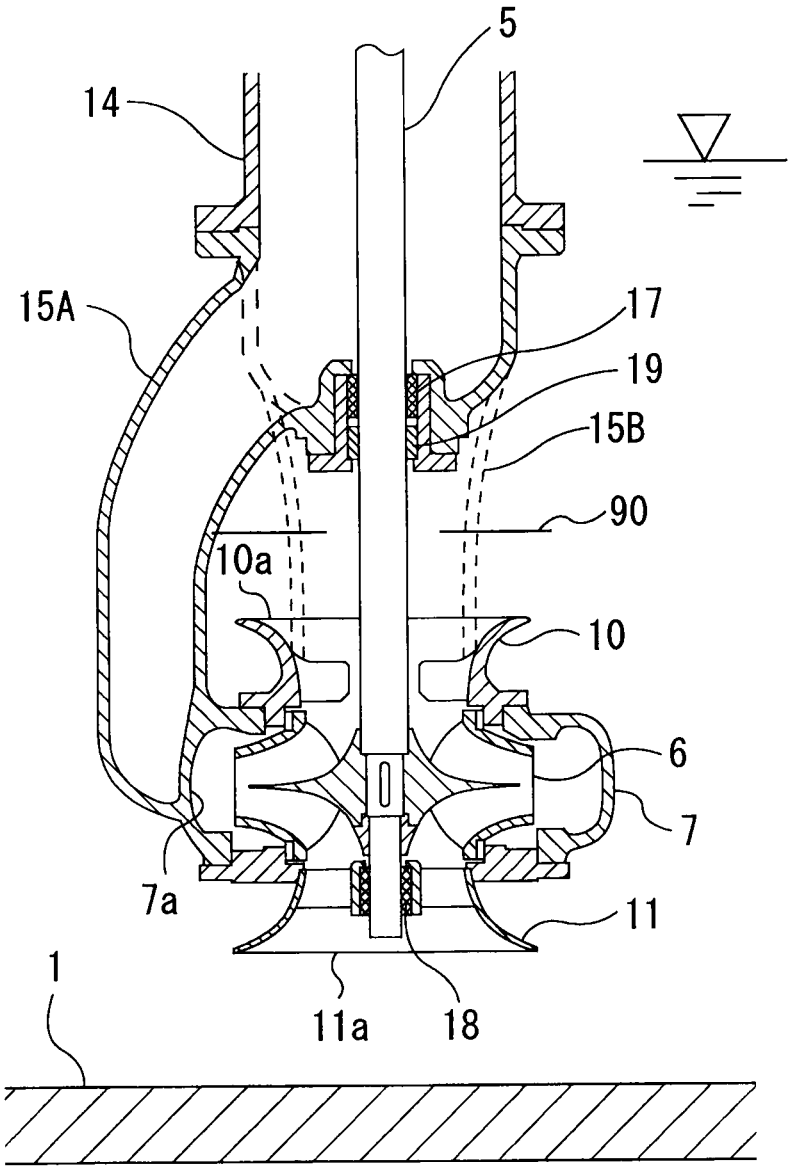
FIG. 22 is a cross-sectional view of the double suction vertical pump including the vortex prevention device according to still another embodiment of the present invention.

FIG. 22 is a cross-sectional view of the double suction vertical pump including the vortex prevention device according to still another embodiment of the present invention. A plate member 90 serving as the vortex prevention structure is provided above the upper suction opening 10*a*. This plate member 90 is arranged away from the upper suction opening 10*a* such that a gap (i.e., water passage) is formed between the plate member 90 and the upper suction opening 10*a*. The plate member 90 is located between the column pipe 14 and the upper suction opening 10*a*. The rotary shaft 5 extends through the plate member 90. The plate member 90 is secured to the above-described two discharge pipes 15A and 15B and is located below the water surface. The plate member 90 has a size (lateral dimension) larger than the diameter of the upper suction opening 10*a* so as to cover the upper suction opening 10*a* with the gap formed between the plate member 90 and the upper suction opening 10*a*.

Figure 23:
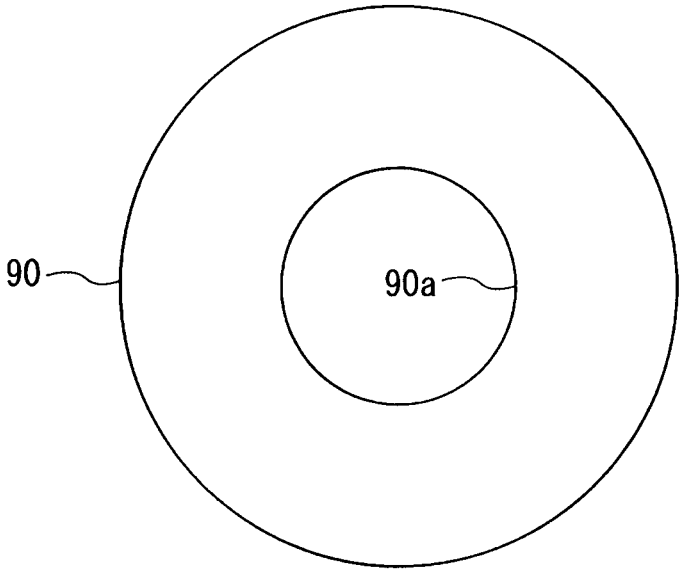
FIG. 23 is a plan view of a plate member shown in FIG. 22.

FIG. 23 is a plan view of the plate member shown in FIG. 22. As shown in FIG. 23, the plate member 90 has an aperture 90*a* at a center thereof. This aperture 90*a* is smaller than the upper suction opening 10*a*, and the plate member 90 in its entirety has a flat annular shape. The aperture 90*a* is located approximately right above the upper suction opening 10*a*. In the example shown in FIG. 22 and FIG. 23, a diameter of the aperture 90*a* is approximately half the diameter of the upper suction opening 10*a*. A part of the water flow is directed to the upper suction opening 10*a* through the aperture 90*a*, so that the water flow in the suction pit 1 is directed downwardly. As a result, speed of the swirling flow on the water surface, which is the trigger for the air entrained vortex, is reduced. In particular, when the water level is higher than the junction of the two discharge pipes 15A and 15B, the plate member 90 can effectively prevent the formation of the air entrained vortex. The plate member 90 may have a peripheral portion that is inclined or curved downward as shown in FIG. 9 or FIG. 11.

Figure 24:
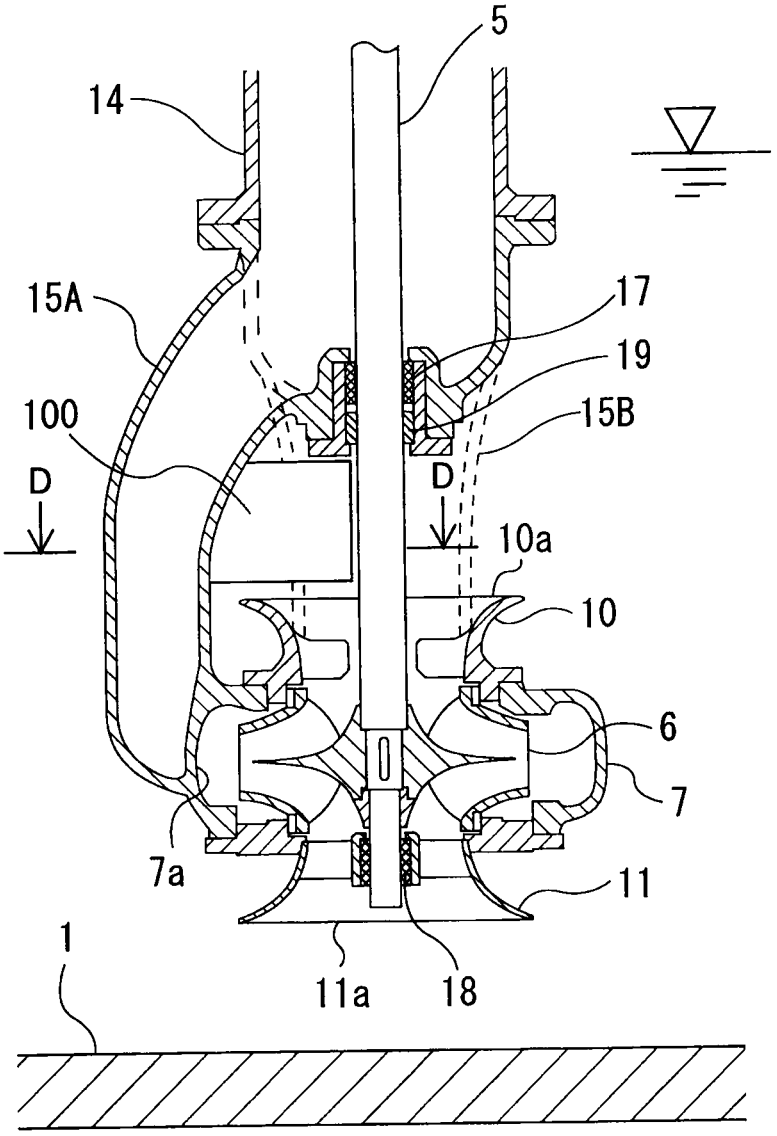
FIG. 24 is a cross-sectional view of the double suction vertical pump including the vortex prevention device according to still another embodiment of the present invention.
Figure 25:
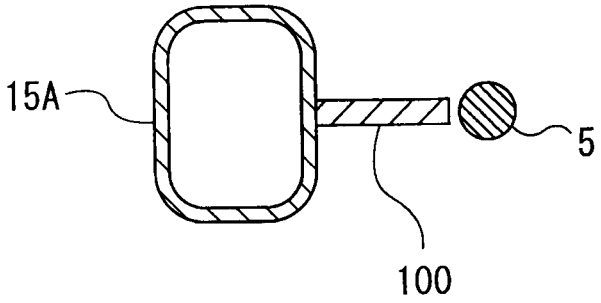
FIG. 25 is a cross-sectional view taken along line D-D shown in FIG. 24.

FIG. 24 is a cross-sectional view of the double suction vertical pump including the vortex prevention device according to still another embodiment of the present invention. FIG. 25 is a cross-sectional view taken along line D-D in FIG. 24. Vertical plates 100 serving as the vortex prevention structure are secured to the two discharge pipes 15A and 15B, respectively. These vertical plates 100 are located between the column pipe 14 and the upper suction opening 10*a* and are arranged above the upper suction opening 10*a*. Although only the vertical plate 100 secured to the discharge pipe 15A is shown in FIG. 24 and FIG. 25, the vertical plate 100 is also secured to the discharge pipe 15B. That is, one vertical plate 100 is secured to each discharge pipe. For example, three vertical plates 100 are provided for three discharge pipes, and four vertical plates 100 are provided for four discharge pipes.

The vertical plates 100 are located near the upper suction opening 10*a*. These vertical plates 100 extend vertically and also extend in the radial direction of the upper suction opening 10*a*. More specifically, the vertical plates 100 extend along the rotary shaft 5 and extend from the discharge pipes 15A and 15B toward the rotary shaft 5. The vertical plates 100 thus arranged can block the flow of water passing through a passage between the discharge pipes 15A and 15B. Therefore, flows of water from both sides of the discharge pipes 15A and 15B can be prevented from merging together, and can thus be prevented from growing into a strong air entrained vortex.

Figure 26:
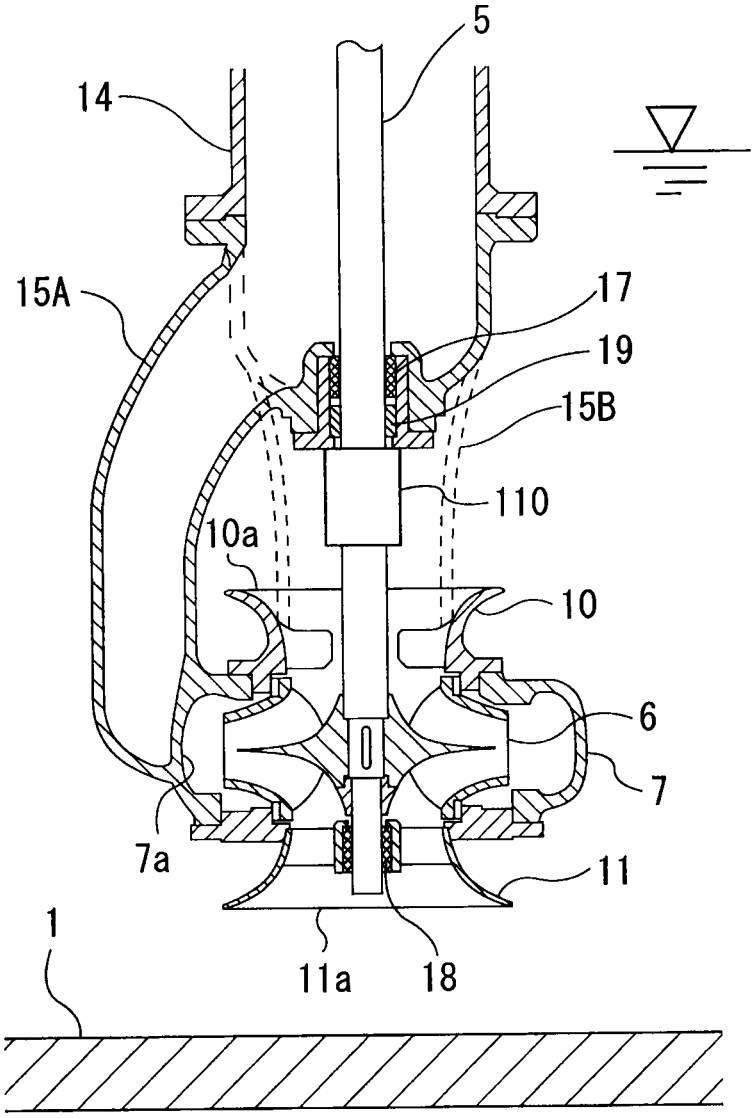
FIG. 26 is a cross-sectional view of the double suction vertical pump including the vortex prevention device according to still another embodiment of the present invention.
Figure 27A:
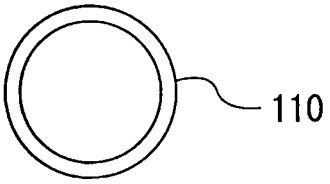
FIG. 27A is a plan view of a cylindrical member shown in FIG. 26.
Figure 27B:
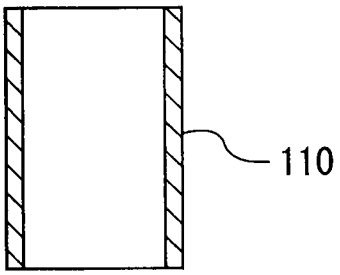
FIG. 27B is a cross-sectional view of the cylindrical member shown in FIG. 26.

FIG. 26 is a cross-sectional view of the double suction vertical pump including the vortex prevention device according to still another embodiment of the present invention. As shown in FIG. 26, a cylindrical member 110 serving as the vortex prevention structure is provided so as to surround the rotary shaft 5. FIG. 27A is a plan view of the cylindrical member shown in FIG. 26, and FIG. 27B is a cross-sectional view of the cylindrical member shown in FIG. 26. An upper end of the cylindrical member 110 is secured to the lower end of the column pipe 14, and a lower end of the cylindrical member 110 is located right above the upper suction opening 10*a*. Specifically, the cylindrical member 110 is arranged so as to surround an exposed portion of the rotary shaft 5. The cylindrical member 110 thus arranged can prevent swirling flow which could be created by the rotation of the rotary shaft 5, and can thus remove an influence on the air entrained vortex.

Figure 28:
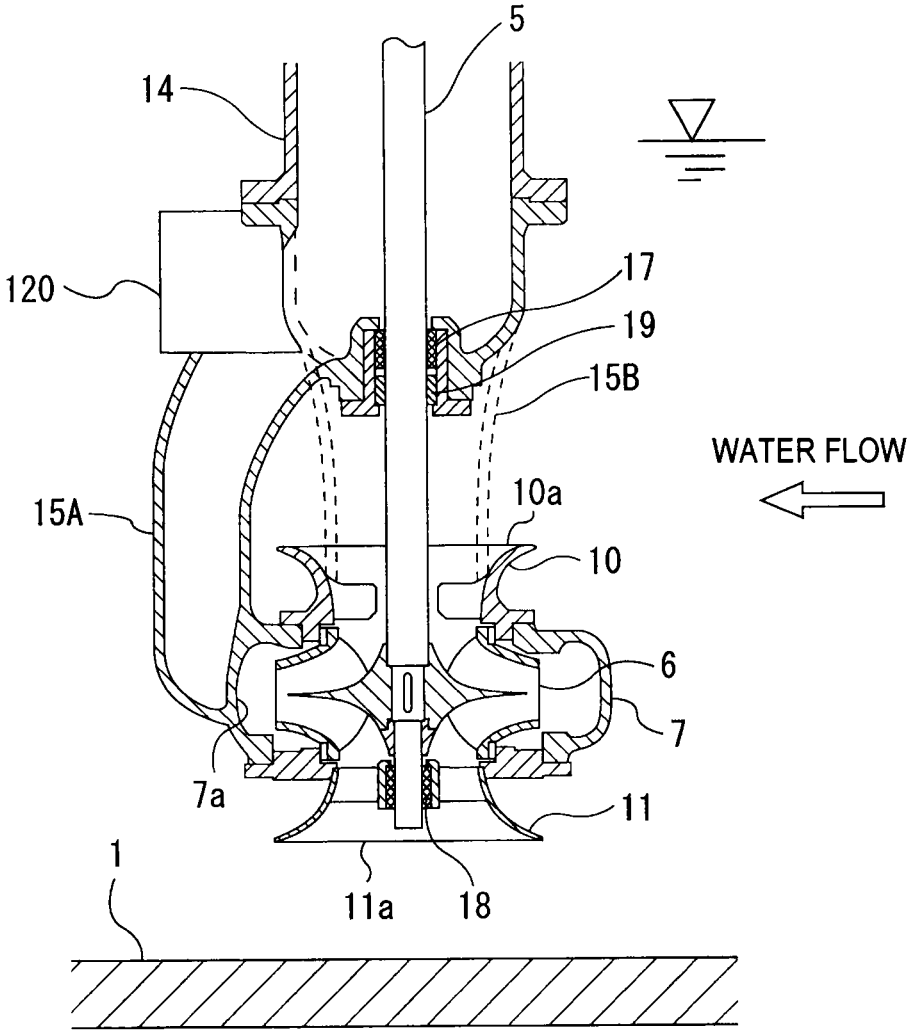
FIG. 28 is a cross-sectional view of the double suction vertical pump including a vortex prevention device according to still another embodiment of the present invention.
Figure 29:
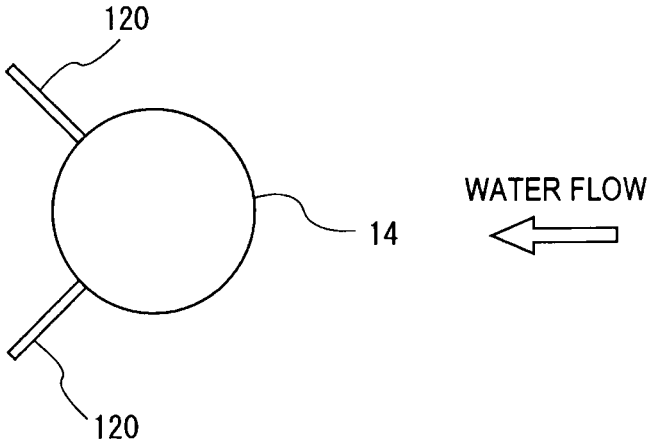
FIG. 29 is a plan view of the vortex prevention structure shown in FIG. 28.

FIG. 28 is a cross-sectional view of the double suction vertical pump including the vortex prevention device according to still another embodiment of the present invention. FIG. 29 is a plane view of the vortex prevention structure shown in FIG. 28. Two vertical plates 120 serving as the vortex prevention structure are secured to a lower portion of the column pipe 14. More specifically, the vertical plates 120 are disposed on the junction of the discharge pipes 15A and 15B. These vertical plates 120 are located above the upper suction opening 10*a*, and their upper ends are located near the water surface in the suction pit 1. Further, the vertical plates 120 are located downstream of the upper suction opening 10*a* with respect to the flow of water in the suction pit 1 and are arranged obliquely with respect to the flow of water in the suction pit 1.

As shown in FIG. 29, the vertical plates 120 are secured to a downstream-side portion of the column pipe 14. The two vertical plates 120 extend approximately in the radial direction of the upper suction opening 10*a* and the column pipe 14. The vertical plates 120 thus arranged can disturb flow of the water surface to destabilize the swirling flow which could trigger the air entrained vortex to thereby prevent the formation of the air entrained vortex.

Figure 30:
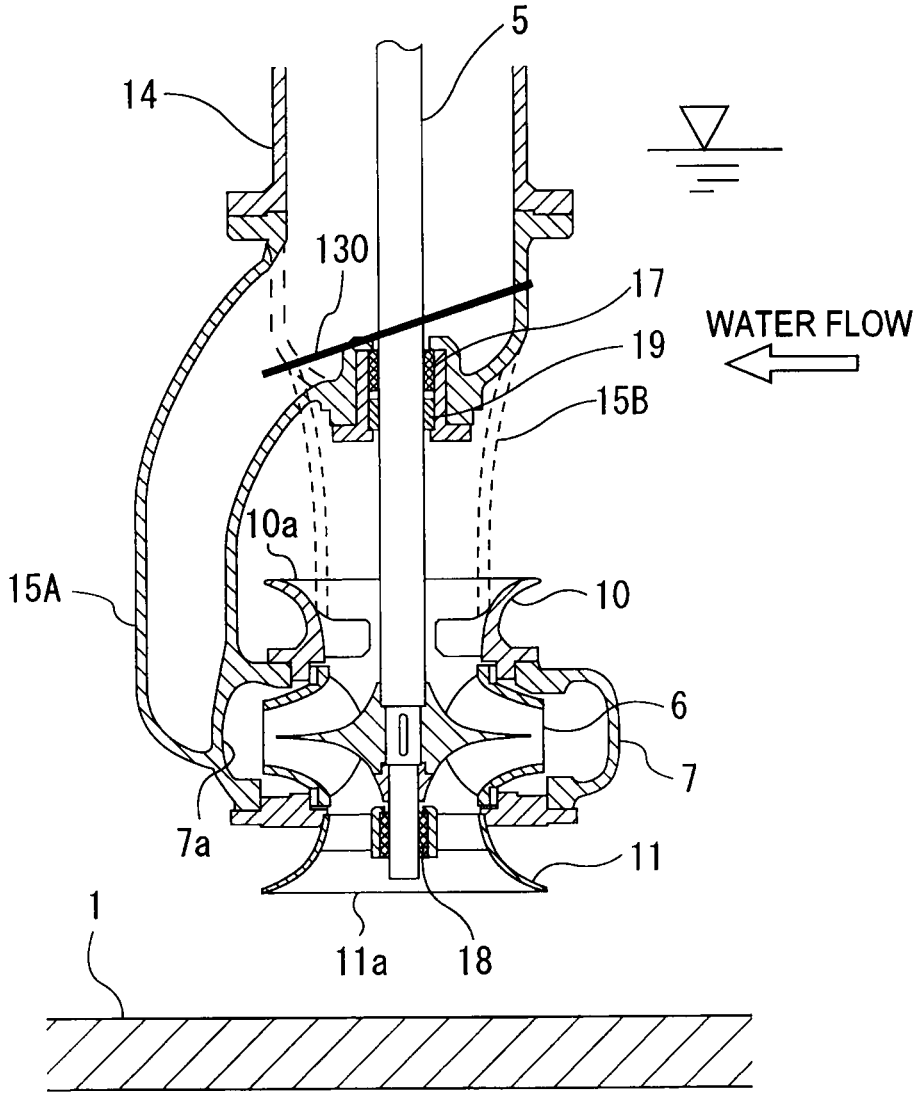
FIG. 30 is a cross-sectional view of the double suction vertical pump including the vortex prevention device according to still another embodiment of the present invention.
Figure 31:
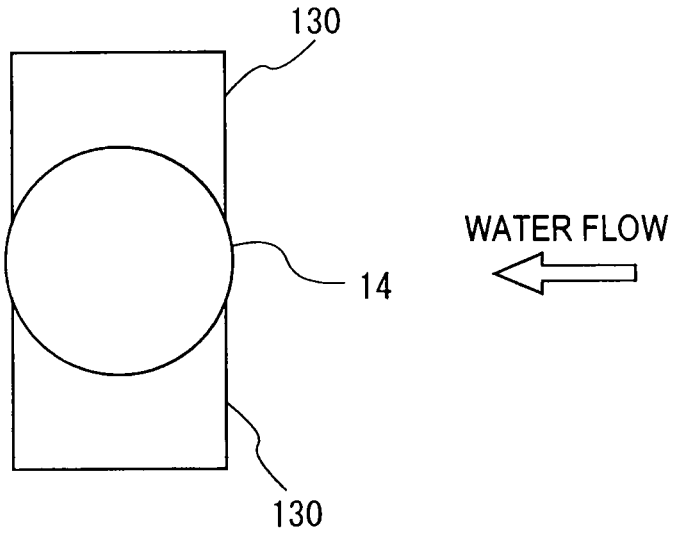
FIG. 31 is a plan view of the vortex prevention structure shown in FIG. 30.

FIG. 30 is a cross-sectional view of the double suction vertical pump including the vortex prevention device according to still another embodiment of the present invention. FIG. 31 is a plan view of the vortex prevention structure shown in FIG. 30. Two slope plates 130 serving as the vortex prevention structure are provided above the upper suction opening 10*a*. More specifically, the slope plates 130 are secured to the lower portion of the column pipe 14. As shown in FIG. 31, these slope plates 130 extend from the column pipe 14 in direction perpendicular to the flow of water in the suction pit 1 as viewed from above. Each slope plate 130 is inclined with respect to the flow of water as viewed from the lateral direction. More specifically, each slope plate 130 is inclined downwardly toward the downstream side with respect to the flow of water in the suction pit 1.

Because the slope plates 130 with the downward gradient along the flow of water in the suction pit 1 are provided near the water surface, the flow of water in the suction pit 1 is directed downwardly by the slope plates 130 and thus the speed of the swirling flow on the water surface, which could trigger the air entrained vortex, is reduced. Further, the slope plates 130 can disturb the flow of the water surface to destabilize the swirling flow on the water surface. When a part of each slope plate 130 emerges from the water surface, the slope plate 130 can destroy the swirling flow on the water surface.

Figure 32:
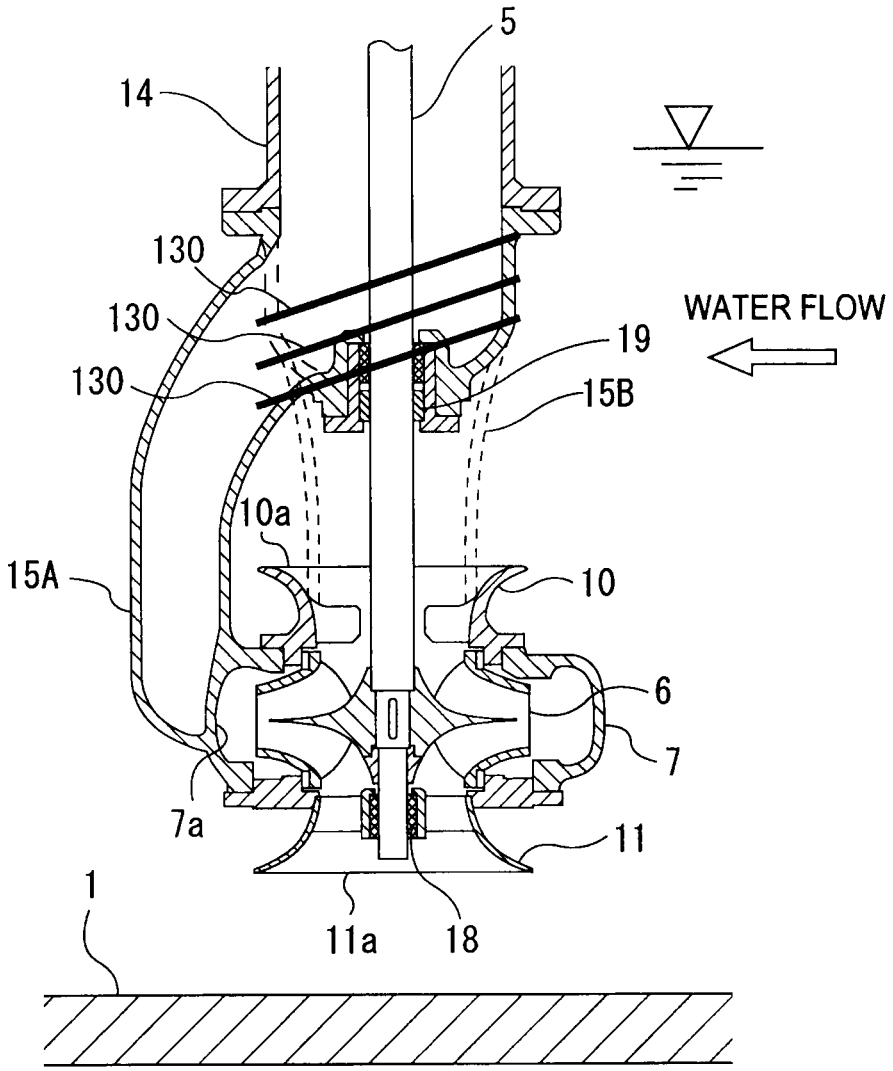
FIG. 32 is a view of a modified example of the vortex prevention device according to the embodiment.

FIG. 32 is a view of a modified example of the vortex prevention device according the embodiment of the present invention. In this example, a plurality of (three in the figure) slope plates 130 are arranged along the vertical direction. These slope plates 130 are secured to the lower portion of the column pipe 14. Each slope plate 130 has the same shape and the same slope angle as those of the slope plate 130 shown in FIG. 30. Further, the slope plates 130 have the same structure as each other. These multiple slope plates 130 arranged in parallel along the vertical direction can prevent the formation of the air entrained vortex over a wider range of the water level.

Figure 33:
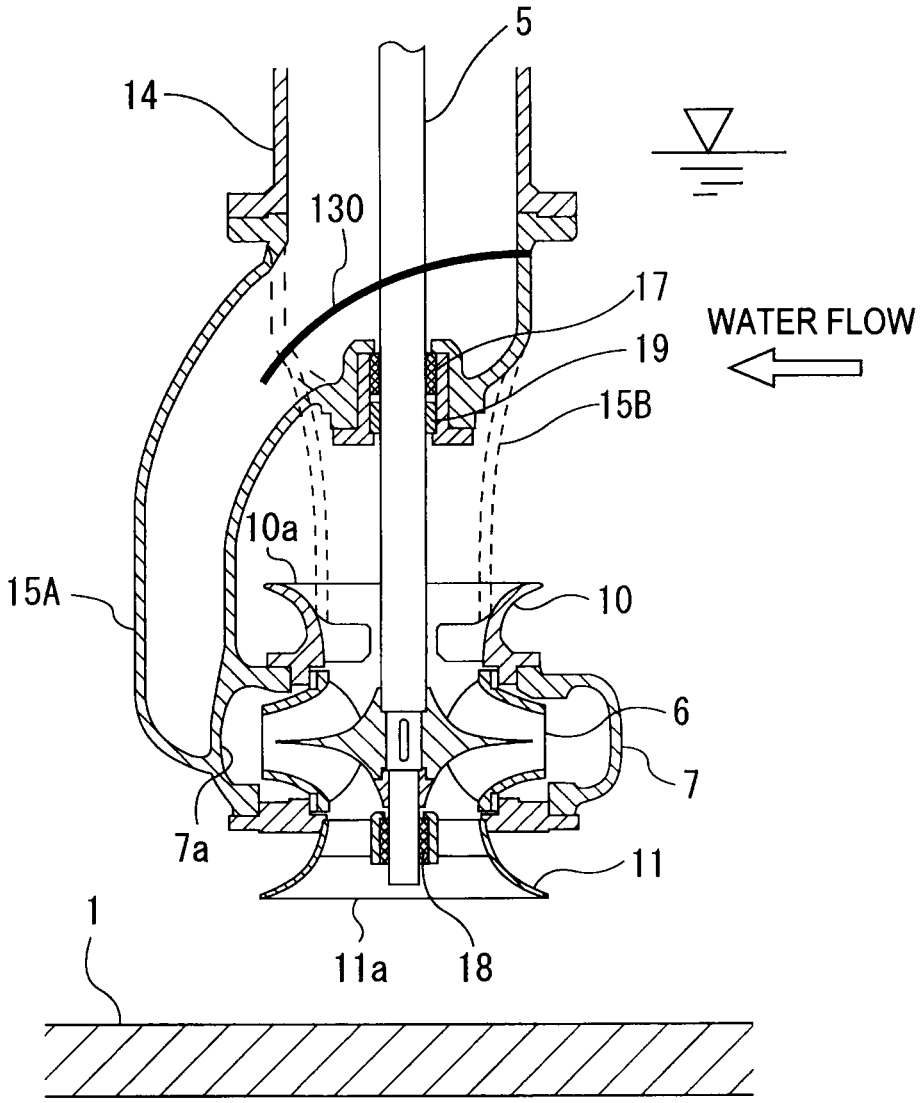
FIG. 33 is a view of another modified example of the vortex prevention device according to the embodiment.

FIG. 33 is a view of another modified example of the vortex prevention device according the embodiment of the present invention. In this example, the slope plate 130 has a curved shape as viewed from the lateral direction. In this example also, the slope plate 130 in its entirety is curved downwardly toward the downstream side with respect to the flow of water in the suction pit 1. Because the slope plate 130 is curved, the stiffness of the slope plate 130 can be enhanced, and therefore the vibration of the slope plate 130, which could be caused by the flow of water, can be prevented.

Figure 34:
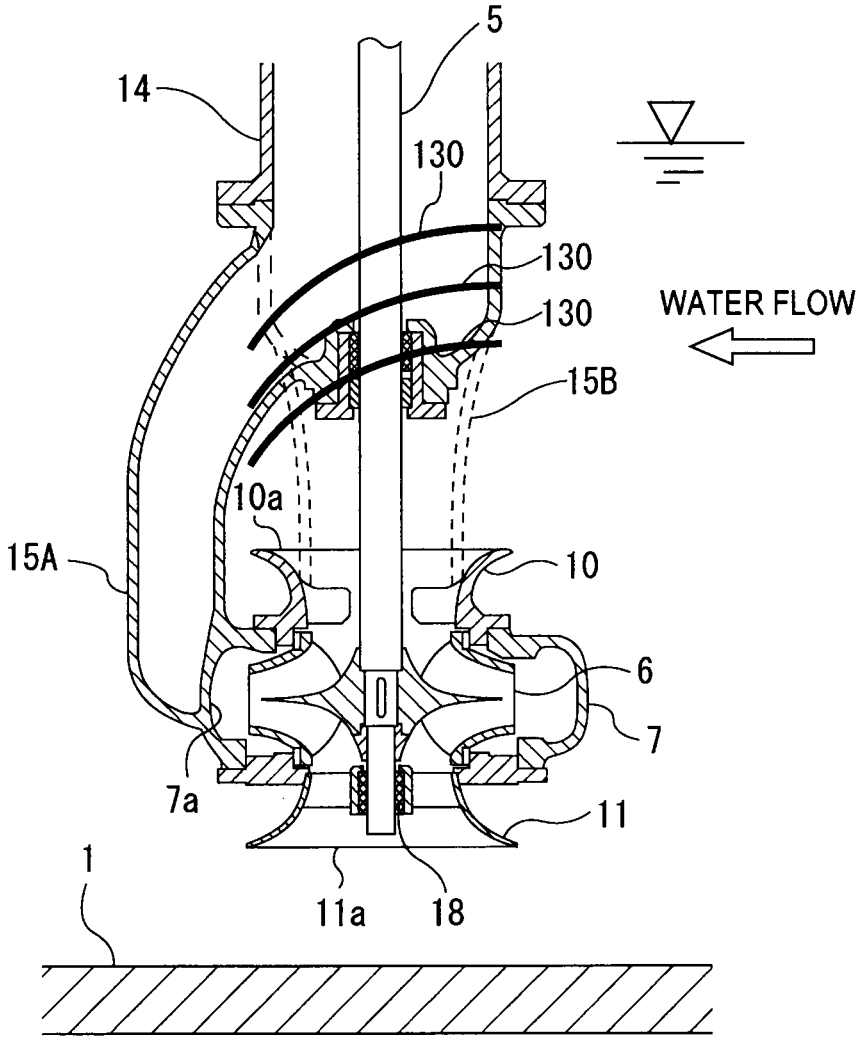
FIG. 34 is a view of still another modified example of the vortex prevention device according to the embodiment.

FIG. 34 is a view of still another modified example of the vortex prevention device according the embodiment of the present invention. In this example, a plurality of (three in the figure) slope plates 130 are arranged along the vertical direction, and each slope plate 130 is curved downwardly toward the downstream side as viewed from the lateral direction, as with the example shown in FIG. 33.

Figure 35:
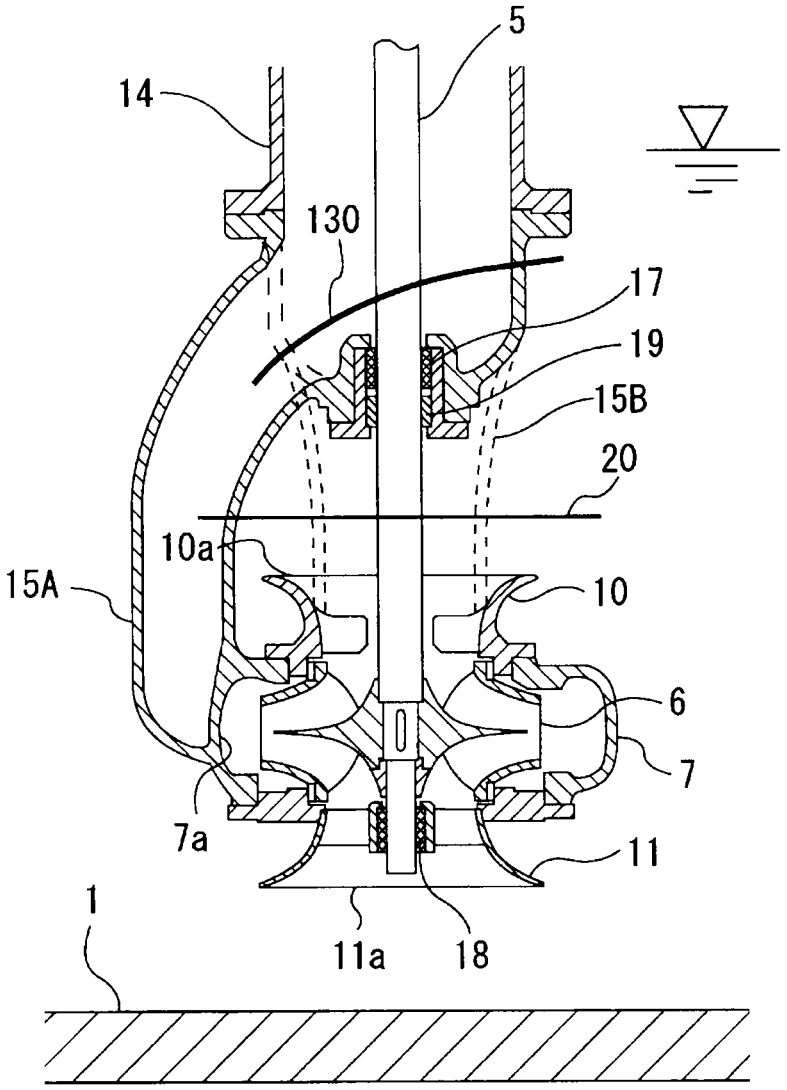
FIG. 35 is a view of an example in which the plate member shown in FIG. 6 and the curved slope plate shown in FIG. 33 are combined.
Figure 36:
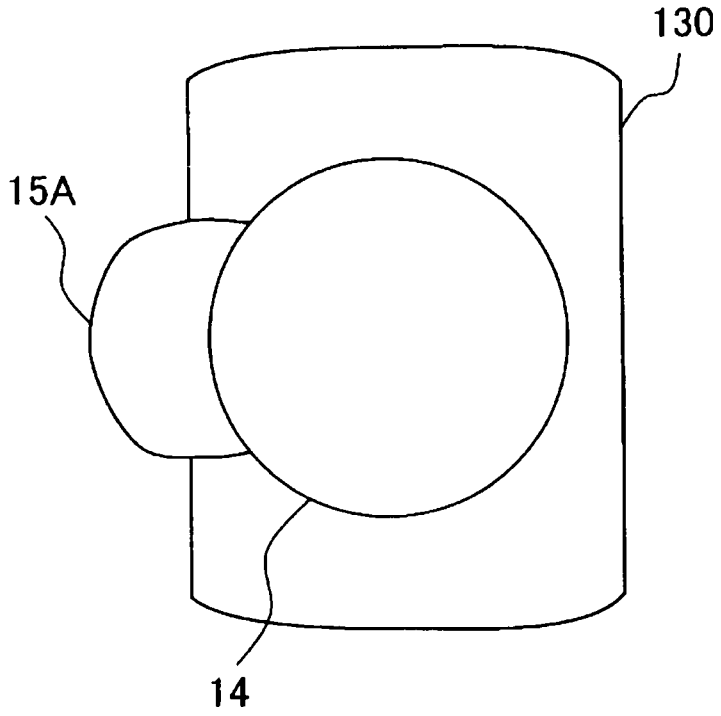
FIG. 36 is a schematic view showing relationship between the plate member, a column pipe, and a discharge pipe shown in FIG. 35.

The above-described embodiments can be combined in an appropriate manner. For example, the plate member 20 shown in FIG. 6 and the vertical plates 120 shown in FIG. 28 may be combined to provide the vortex prevention structure that can prevent the air entrained vortex over a wide range of the water level. Further, the plate member 20 shown in FIG. 6 and the slope plates 130 shown in FIG. 30 may be combined to provide the vortex prevention structure that can prevent the air entrained vortex in a wide range of the water level. FIG. 35 is an example in which the plate member 20 shown in FIG. 6 and the curved slope plate 130 shown in FIG. 33 are combined. FIG. 36 is a plan view schematically showing a relationship between the slope plate 130, the column pipe 14, and the discharge pipe 15A shown in FIG. 35. In this example shown in FIG. 35, the plate member 20 and the slope plate 130 are modified. The plate member 20 does not have the projecting portion 20*a* shown in FIG. 7 and is constructed by a simple circular plate. The slope plate 130 has an extended upper edge that extends in the upstream direction of the flow of water in the suction pit 1. Such combination can also prevent the air entrained vortex over a wide range of the water level.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a vortex prevention device for preventing air entrained vortex and submerged vortex which would be created when pumping water in a pump pit. The present invention is also applicable to a double suction vertical pump provided with such a vortex prevention device.

The invention claimed is:

1. A double suction vertical pump installed in an open channel, comprising:

a rotary shaft extending in a vertical direction;

a double suction impeller secured to the rotary shaft;

a casing having a volute chamber that surrounds the double suction impeller;

an upper bell mouth having an upper suction opening;

a lower bell mouth having a lower suction opening, the upper suction opening and the lower suction opening being in fluid communication with the volute chamber through the double suction impeller;

discharge pipes extending upwardly from the volute chamber;

a column pipe coupled to the discharge pipes; and a vortex prevention device located above the upper bell mouth, the vortex prevention device being secured to the column pipe or the discharge pipes.

2. The double suction vertical pump according to claim 1, wherein the vortex prevention device is separated from the upper suction opening.

3. The double suction vertical pump according to claim 1, wherein the vortex prevention device comprises at least one slope plate secured to the column pipe.

4. The double suction vertical pump according to claim 3, wherein the at least one slope plate is inclined downwardly toward a downstream side with respect to a flow of fluid in the open channel.

5. The double suction vertical pump according to claim 1, wherein the vortex prevention device comprises a cylindrical member surrounding the rotary shaft, the cylindrical member having an upper end that is secured to a lower end of the column pipe.

6. A double suction vertical pump installed in an open channel, comprising:

a rotary shaft extending in a vertical direction;

a double suction impeller secured to the rotary shaft;

a casing having a volute chamber that surrounds the double suction impeller;

an upper suction opening and a lower suction opening that are in fluid communication with the volute chamber through the double suction impeller;

discharge pipes extending upwardly from the volute chamber;

a column pipe coupled to the discharge pipes; and a vortex prevention device located above the upper suction opening, the vortex prevention device being secured to the column pipe or the discharge pipes, wherein the vortex prevention device comprises vertical plates secured to the discharge pipes, the vertical plates extending along the rotary shaft and extending from the discharge pipes toward the rotary shaft.

* * * * *